US006689549B1

(12) United States Patent
Begley et al.

(10) Patent No.: US 6,689,549 B1
(45) Date of Patent: Feb. 10, 2004

(54) PHOTOGRAPHIC ELEMENT, COMPOUND, AND PROCESS

(75) Inventors: William J. Begley, Webster, NY (US); Brian Thomas, Pittsford, NY (US); Natasha Andrievsky, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/316,578

(22) Filed: Dec. 11, 2002

(51) Int. Cl.[7] ..... G03C 7/46

(52) U.S. Cl. ..... 430/384; 430/385; 430/552; 430/553

(58) Field of Search ..... 430/552, 553, 430/384, 385

(56) References Cited

U.S. PATENT DOCUMENTS

| | | | | |
|---|---|---|---|---|
| 5,686,235 | A | 11/1997 | Lau et al. | |
| 5,789,146 | A | 8/1998 | Miller et al. | |
| 6,132,947 | A | 10/2000 | Honan et al. | |
| 6,180,331 | B1 | 1/2001 | Begley et al. | |
| 6,190,850 | B1 | 2/2001 | Begley et al. | |
| 6,190,851 | B1 | 2/2001 | Harder et al. | |
| 6,194,132 | B1 | 2/2001 | Begley et al. | |
| 6,197,490 | B1 | 3/2001 | Begley et al. | |
| 6,197,491 | B1 * | 3/2001 | Begley et al. | 430/553 |
| 6,197,492 | B1 * | 3/2001 | Begley et al. | 430/553 |
| 6,207,363 | B1 | 3/2001 | Begley et al. | |
| 6,251,575 | B1 * | 6/2001 | Begley et al. | 430/553 |
| 6,387,606 | B1 * | 5/2002 | Begley et al. | 430/384 |

* cited by examiner

*Primary Examiner*—Geraldine Letscher
(74) *Attorney, Agent, or Firm*—Arthur E. Kluegel

(57) ABSTRACT

Disclosed is a photographic element comprising a light-sensitive silver halide emulsion layer having associated therewith a cyan coupler having the formula:

(I)

wherein:

the term "NB coupler" represents a coupler of formula (I) that forms a dye with the developer 4-amino-3-methyl-N-ethyl-N-(2-methanesulfonamidoethyl) aniline sesquisulfate hydrate for which the left bandwidth (LBW) using spin-coating is at least 5nm less than that of the same dye in solution form;

V is a sulfone, sulfoxide or sulfonamide-containing group;

Y is H or a coupling-off group;

each $Z_1$, $Z_2$, $Z_3$ and Z* are an independently selected substituent group where p is 0 to 2;

provided that $Z_1$, and $Z_2$ or $Z_2$ and $Z_3$ can join to form a ring;

provided further that $Z_1$, and $Z_2$ do not join to form an aromatic or heterocyclic ring; and provided further that the combined sum of the aliphatic carbon atoms in V, all Z', Z" and all Z* is at least 8.

29 Claims, No Drawings

PHOTOGRAPHIC ELEMENT, COMPOUND, AND PROCESS

FIELD OF THE INVENTION

This invention relates to a silver halide photographic element containing a phenolic cyan dye-forming coupler bearing a substituted or unsubstituted vinyl carbonamido group in the 2-position and a carbonamido substituent bearing a sulfone, sulfoxide or sulfonamide group in the 5-position.

BACKGROUND OF THE INVENTION

In silver halide based color photography, a typical photographic element contains multiple layers of light-sensitive photographic silver halide emulsions coated on a support with one or more of these layers being spectrally sensitized to each of blue light, green light and red light. The blue, green, and red light-sensitive layers typically contain yellow, magenta, and cyan dye-forming couplers, respectively. After exposure to light, color development is accomplished by immersing the exposed material in an aqueous alkali solution containing an aromatic primary amine color-developing agent. The dye-forming couplers are selected so as to react with the oxidized color developing agent to provide yellow, magenta and cyan dyes in the so called subtractive color process to reproduce their complementary colors, blue, green and red as in the original image.

The important features for selecting the dye-forming coupler include, efficient reaction with oxidized color developing agent, thus minimizing the necessary amounts of coupler and silver halide in the photographic element; the formation of dyes with hues appropriate for the photographic use of interest, for color photographic paper applications this requires that dyes have low unwanted side absorption leading to good color reproduction in the photographic print; minimization of image dye loss contributing to improved image permanence under both ambient illumination and conventional storage conditions; and in addition the selected dye-forming coupler must exhibit good solubility in coupler solvents, provide good dispersibility in gelatin and remain stable during handling and manipulation for maximum efficiency in manufacturing processes.

In recent years, a great deal of study has been conducted to improve dye-forming couplers for silver halide photosensitive materials in terms of improved color reproducibility and image dye stability. However, further improvements are needed, particularly in the area of cyan couplers. In general, cyan dyes are formed from naphthols and phenols as described, for example, in U.S. Pat. Nos. 2,367,351, 2,423,730, 2,474,293, 2,772,161, 2,772,162, 2,895,826, 2,920,961, 3,002,836, 3,466,622, 3,476,563, 3,552,962, 3,758,308, 3,779,763, 3,839,044, 3,880,661, 3,998,642, 4,333,999, 4,990,436, 4,960,685, and 5,476,757; in French patents 1,478,188 and 1,479,043; and in British patent 2,070,000. These types of couplers can be used either by being incorporated in the photographic silver halide emulsion layers or externally in the processing baths. In the former case the couplers must have ballast substituents built into the molecule to prevent the couplers from migrating from one layer into another. Although these couplers have been used extensively in color photographic film and paper products, the dyes derived from them still suffer from poor stability to heat, humidity or light, low coupling efficiency or optical density, and in particular from undesirable blue and green absorptions which cause considerable reduction in color reproduction and color saturation.

Cyan couplers which have been recently proposed to overcome some of these problems are 2,5-diacylaminophenols containing a sulfone, sulfonamido or sulfate moiety in the ballasts at the 5-position, as disclosed in U.S. Pat. Nos. 4,609,619, 4,775,616, 4,849,328, 5,008,180, 5,045,442, and 5,183,729; and Japanese patent applications JP02035450 A2, JP01253742 A2, JP04163448 A2, JP04212152 A2, and JP05204110 A2. Even though cyan image dyes formed from these couplers allege in various instances improved stability to heat and humidity, enhanced optical density and resistance to reduction by ferrous ions in the bleach bath, the dye absorption maxima ($\lambda_{max}$) are too hypsochromically shifted (that is, shifted to the blue end of the visible spectrum) and the absorption spectra are too broad with considerable amounts of undesirable blue and green absorptions and often lack sufficient stability toward light fading. Thus, these couplers are not acceptable for use in color papers and print applications.

The hue of a dye is a function of both the shape and the position of its spectral absorption band. Traditionally, the cyan dyes used in color photographic papers have had nearly synnetrical absorption bands centered in the region of 620 to 680 nm, typically 630 to 660 nm. Such dyes have rather large amounts of unwanted absorption in the green and blue regions of the spectrum.

More desirable would be a dye whose absorption band is asymmetrical in nature and biased towards the green region, that is, with a steep slope on the short wavelength side. The half-bandwidth on the short side of the curve, also called the left half-bandwidth or LBW, is desirably narrowed. Such a dye would suitably peak at a shorter wavelength than a dye with symmetrical absorption band, but the exact position of the desired peak depends on several factors including the degree of asymmetry and the shapes and positions of the absorption bands of the magenta and yellow dyes with which it is associated.

Recently, Lau et al., in U.S. Pat. No. 5,686,235, and Begley et al., in U.S. Pat. Nos. 6,387,606, 6,251,575, 6,207,363, 6,201,125, 6,197,492, 6,197,491, 6,197,490, 6,197,489, 6,194,132, 6,190,850, 6,180,331, 6,180,328, and 6,132,947 describe particular classes of cyan dye-forming couplers that have been shown to improve thermal stability and hue, particularly, with decreased absorption in side bands and absorption bands that are asymmetrical in nature. The couplers disclosed as suitable contain a sulfone, sulfoxide or sulfonamide groups bonded to the 2 or 3-positions of a carbonamido group at the 5-position of the phenolic ring and contain a carbocyclic or heterocyclic containing carbonamido group in the 2-position of the phenolic ring. Other related patents are U.S. Pat. Nos. 5,047,314, 5,047,315, 5,057,408, 5,162,197, and 5,789,146.

Although the couplers of Lau et al. and Begley et al. provide advantageous spectra, it is desirable to discover alternative phenolic structures that will accomplish the same result and that may provide other desirable features. Particularly desirable features of phenolic couplers in photographic systems are those of increased coupler solubility, lower crystallinity and lower melting points. Such features allow for the easier incorporation of the coupler into the photographic element and lower the propensity of the coupler to crystallize once incorporated into the element. Honan et al., U.S. Pat. Nos. 6,132,947, 6,190,851 and 6,110,658, describes methods and procedures to overcome the incorporation of less soluble couplers into photographic elements. However, such methods and procedures severely limit the location and types of addenda such as stabilizer and coupler solvent which can be used in film building. Chemical variations may enable advances in the ability to better select the desired curve shape, wavelength of maximum absorption, coupler solubility, lower crystallinity, lower melting points and other properties such as coupler and dye light and dark stability, reactivity etc.

Japanese published application 59-111,645 suggests certain phenolic couplers having an α-sulfonyl substituent in a 5-carbonamido substituent that forms a dye having a maximum absorption at "about 660 nm" with examples of 657–660 nm. It appears that the spectral curves of the disclosed dyes exhibit the usual broad absorption band but that the curve has been shifted to the long wavelength side in order to reduce the unwanted absorption on the short wavelength side. The disclosed compounds do not provide the desired narrow LBW and shorter wavelength of maximum absorption.

In spite of the ongoing efforts to discover soluble, low crystallinity couplers that produce dyes having advantageous absorption properties, such couplers, even if obtained, will have limited utility if the formed dyes are not sufficiently stable.

The problem to be solved is to provide an alternative photographic element, compound, and process, employing a cyan dye-forming phenolic coupler soluble in photographic coupler solvents with low crystallinity, which forms a dye having a narrowed LBW and corresponding lower unwanted side absorptions.

SUMMARY OF THE INVENTION

The invention provides a photographic element comprising a light-sensitive silver halide emulsion layer having associated therewith a cyan "NB coupler" having the formula:

(I)

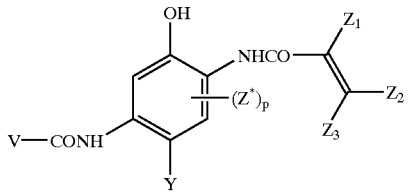

wherein:

the term "NB coupler" represents a coupler of formula (I) that 5 forms a dye with the developer 4-amino-3-methyl-N-ethyl-N-(2-methanesulfonamidoethyl) aniline sesquisulfate hydrate for which the left bandwidth (LBW) using spin-coating is at least Sni less than that of the same dye in solution form;

V is a sulfone, sulfoxide or sulfonamide-containing group;

Y is H or a coupling-off group;

each $Z_1$, $Z_2$, $Z_3$ and Z* are an independently selected substituent group where p is independently 0 to 2;

provided that $Z_1$ and $Z_2$ or $Z_2$ and $Z_3$ can join to form a ring;

provided further that $Z_1$ and $Z_2$ do not join to form an aromatic or heterocyclic ring; and provided further that the combined sum of the aliphatic carbon atoms in V, all $Z_1$, $Z_2$, $Z_3$ and all Z* is at least 8.

The invention also provides a coupler of formula (I) and an imaging method employing the element. The cyan "NB coupler" of the invention exhibits advantageous solubility in photographic coupler solvents, and the dye formed in the element exhibits an advantageous dye hue in having a reduced level of unwanted absorption on the short wavelength side of the spectrum and increased stability.

DETAILED DESCRIPTION OF THE INVENTION

The invention may be generally described as summarized above. The coupler is an "NB coupler" which is a narrow bandwidth coupler of formula (I) having substituents so that there is a reduction in left bandwidth in spin-coating form vs. solution form of at least 5 nm. In accordance with the procedure, a dye is formed by combining the coupler and the developer 4-amino-3-methyl-N-ethyl-N-(2-methanesulfonamidoethyl) aniline sesquisulfate hydrate. If the left bandwidth (LBW) of its absorption spectrum upon "spin coating" of a 3% w/v solution of the dye in ethyl acetate or other suitable solvent with 3% w/v of di-n-butyl sebacate coupler solvent is at least 5 nm less than the LBW for a solution of the same dye in acetonitrile, then the coupler is an "NB Coupler". The LBW of the spectral curve for a dye is the distance between the left side of the spectral curve and the wavelength of maximum absorption measured at a density of half the maximum.

Although the specific developer identified above is used for the NB coupler determination, it is understood that the effect with this developer is predictive and that the element and the couplers useful in the invention may be processed with any color developer such as the conventional p-phenylene diamine developers.

The "spin coating" sample is prepared by first preparing a 3% w/v solution of the dye in ethyl acetate or other suitable solvent with 3% w/v of di-n-butyl sebacate coupler solvent. If the dye is insoluble, dissolution is achieved by the addition of methylene chloride or tetrahydrofuran. The solution is filtered and 0.1–0.2 ml is applied to a clear polyethylene terephthalate support (approximately 4 cm×4 cm) and spun at 4,000 RPM using the Spin Coating equipment, Model No. EC101, available from Headway Research Inc., Garland Tex. The transmission spectra of the so prepared dye samples are then recorded.

Preferred "NB couplers" form a dye which has a LBW of the absorption spectra upon "spin coating" a sample of the dye in di-n-butyl sebacate at least 5 nm, preferably at least 10 nm, 1 Sum or 20nm, but can fall in the range of 30 between 5 to 40 nm less than that of the same dye in acetonitrile solution.

As used herein the term "soluble" with reference to a coupler means that the coupler has a low tendency to crystallize out of the dispersion during 7 day aging and desirably for a further extended period of 48 hours at 45° C.

The following limitations apply to formulae (I)–(XI) as appropriate:

V represents a group comprising a sulfone, sulfoxide or sulfonamide group. Preferably the group comprises a sulfone or sulfonamide group and most preferably an aromatic sulfone group such as a phenylsulfone group.

Y is H or a coupling-off group. Coupling-off groups are more fully described hereinafter. Typically, Y is H, halogen such as chloro, aryloxy such as phenoxy, or alkoxy.

L is any divalent linking group suitable for connecting the carbonamido group to the sulfur or nitrogen atom of V. It may, for example, represent a substituted or unsubstituted alkyl or aromatic group and may include a heteroatom, and it may comprise a combination of the foregoing.

$R_1$, $R_2$, $R_3$ and $R_4$ are independently hydrogen, aryl or an alkyl group of 1 to 5 carbon atoms. Other groups and alkyl groups of longer chain length diminish the hue advantage. Desirably, one of $R_1$ and $R_2$ is hydrogen and the other is an alkyl group such as methyl or ethyl. Both may be hydrogen or both may be alkyl. When structures of the invention include $R_3$ and $R_4$, desirably, one of $R_3$ and $R_4$ can be hydrogen and the other can be an alkyl group such as methyl or ethyl. Both $R_3$ and $R_4$ may be hydrogen or both may be alkyl. It is also possible that the employed alkyl groups are substituted to provide, for example, a perfluorinated substituent.

Each $Z_1$, $Z_2$, $Z_3$, $Z^*$, and $Z^\#$ is an independently selected substituent group where p is 0 to 2 and m is 0 to 5. Suitable substituent groups are more fully described hereinafter. Typically p is 0. $Z_1$, $Z_2$, $Z_3$, $Z^*$, and $Z^\#$ may be any substituent and, for example, may be independently selected from hydrogen, acyl, acyloxy, alkenyl, alkyl, alkoxy, amino, mono and di-substituted amino, aryl, aryloxy, carbamoyl, carbamate, carbonamido, carboxy, carboalkoxy, cyano, halogen, heterocyclic, hydroxy, nitro, oxycarbonyl, oxysulfonyl, sulfamoyl, sulfonamido, sulfonyl, sulfoxide, thio and ureido groups. Convenient substituents are hydrogen, acyl, acyloxy, alkenyl, alkyl, alkoxy, halogen, oxycarbonyl, carbonamido, carboxy, carboalkoxy, cyano, sulfonyl and sulfoxide groups. Additionally, $Z_1$, and $Z_2$, or $Z_2$ and $Z_3$ can join to form a ring. When $Z_1$, and $Z_2$ join to form a ring, the ring can be a non-aromatic carbocyclic ring but not an aromatic or heterocyclic ring. When $Z_2$ and $Z_3$ join to form a ring, the ring can be carbocyclic or heterocyclic. When $Z_1$, $Z_2$, or $Z_3$ is alkenyl, the alkenyl group(s) can be further substituted with the aforementioned substituents, $Z_1'$, $Z_2'$, and $Z_3'$, including additional alkenyl groups leading to couplers with conjugated double bonds. The substituents of the additional alkenyl group, $Z_1'$ and $Z_2'$, or $Z_2'$ and $Z_3'$ can also join to form a carbocyclic or heterocyclic ring. Since structures of the invention involve a double bond(s) at the 2-position, it should be realized that geometrical isomerism is possible with certain combinations of $Z_1$, $Z_2$ and $Z_3$ or $Z_1'$, $Z_2'$, and $Z_3'$. That is, cis and trans isomers are possible with certain combinations of $Z_1$, $Z_2$ and $Z_3$ or $Z_1'$, $Z_2'$, and $Z_3'$. The total combined sum of the aliphatic carbon atoms in V, L, $R_1$, $R_2$, $R_3$, $R_4$, $Z_1$, $Z_2$, $Z_3$, $Z_4$, $Z_1'$, $Z_2'$, $Z_3'$, all $Z^*$ and all $Z^\#$ groups is at least 8.

$W_1$ independently represent the atoms necessary to form a carbocyclic or heterocyclic ring group. Examples of suitable carbocyclic rings include cyclohexyl, phenyl and naphthyl with phenyl rings being most conveniently used. Suitable heterocyclic rings include those containing 5 or 6 ring members and at least one ring heteroatom. Heterocycles useful herein may be aromatic or non-aromatic and contain at least one atom of oxygen, nitrogen, sulfur, selenium, or tellurium. They can be fused with a carbocyclic ring or with another heterocycle. They can be attached to the coupler through any of the possible points of attachment on the heterocycle. It should be realized that multiple points of attachment are possible giving rise to alternative isomers for a single heterocycle. Examples of useful heterocyclic groups are benzimidazolyl, benzoselenazolyl, benzothiazolyl, benzoxazolyl, chromonyl, furyl, imidazolyl, indazolyl, indolyl, isoquinolyl, isothiazolyl, isoxazolyl, morpholinyl, oxadiazolyl, oxazolyl, picolinyl, piperidinyl, purinyl, pyradazinyl, pyranyl, pyrazinyl, pyrazolyl, pyridyl, pyrimidinyl, pyrrolyl, pyrrolidinyl, quinaldinyl, quinazolinyl, quinolyl, quinoxalinyl, selenazoyl, tellurazolyl, tetrazolyl, tetrahydrofaryl, thiadiazolyl, thiamorpholinyl, thiatriazolyl, thiazolyl, thienyl, thiophenyl, and triazolyl groups. A particularly useful heterocyclic group is pyridyl in which the nitrogen of the heterocyclic ring may be either ortho, meta or para to the sulfur atom of the sulfoxide, sulfone or sulfonamide groups.

In one embodiment the coupler of formula (I) is represented by formula (II):

(II)

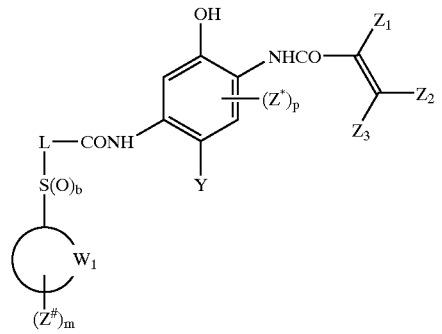

wherein:

L is a linking group;

b is 1 or 2;

each $Z^\#$ is an independently selected substituent group where m is 0 to 5;

$W_1$ represents the atoms necessary to complete a heterocyclic or carbocyclic ring group; and provided that the combined sum of the aliphatic carbon atoms in L, $Z_1$, $Z_2$, $Z_3$, all $Z^*$, and all $Z^\#$ is at least 8.

In another embodiment, the coupler of formula (II) is represented by formula (III):

(III)

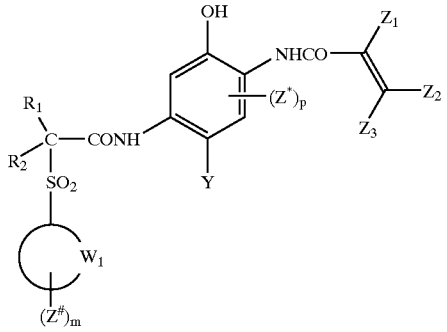

wherein:

$R_1$ and $R_2$ are independently hydrogen, aryl or an alkyl group of 1 to 5 carbon atoms; and provided that-the combined sum of the aliphatic carbon atoms in $Z_1$, $Z_2$, $Z_3$, all $Z^*$, all $Z^\#$, $R_1$ and $R_2$ is at least 8.

In another embodiment, the coupler of formula (II) is represented by formula (IV):

(IV)

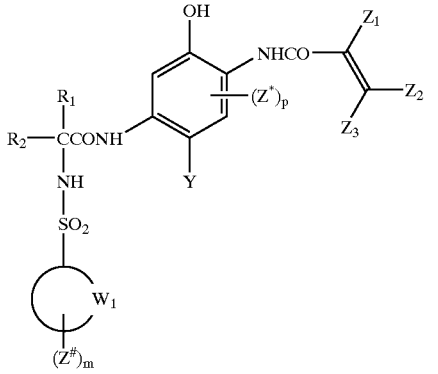

wherein:

$R_1$ and $R_2$ are independently hydrogen, aryl or an alkyl group of 1 to 5 carbon atoms; and provided that the combined sum of the aliphatic carbon atoms in $Z_1$, $Z_2$, $Z_3$, all $Z^*$, all $Z^\#$, $R_1$ and $R_2$ is at least 8.

In a still further embodiment, the coupler of formula (II) is represented by formula (V).

(V)

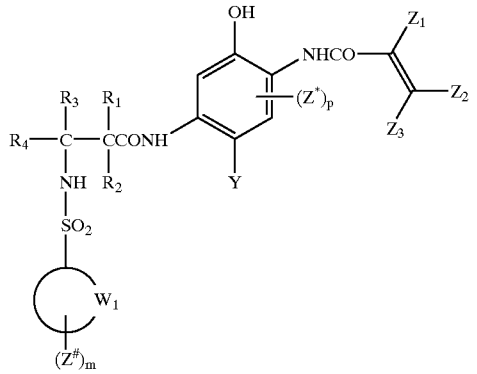

wherein:

$R_1$, $R_2$, $R_3$ and $R_4$ are independently hydrogen, aryl or an alkyl group of 1 to 5 carbon atoms; and provided that the combined sum of the aliphatic carbon atoms in $Z_1$, $Z_2$, $Z_3$, all $Z^*$, all $Z^\#$, $R_1$, $R_2$, $R_3$ and $R_4$ is at least 8.

A preferred embodiment of the invention when $W_1$ represents the atoms necessary to form a carbocyclic ring, is represented by formula (VI):

(VI)

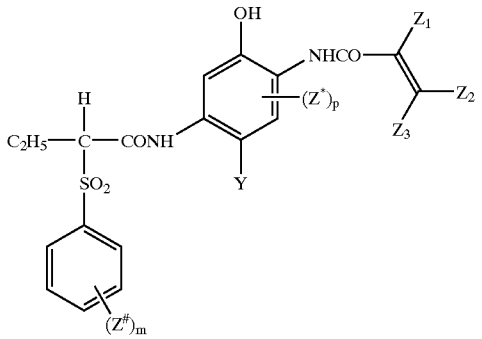

Examples of suitable heterocycles for $W_1$ are those based on a benzimidazole, benzotriazole, furan, imidazole, indazole, indole, isoquinoline, purine, pyrazole, pyridine, pyrimidine, pyrrole, quinoline, thiophene, 1,2,3-triazole, or 1,2,4-triazole ring group. Conveniently useful are the nitrogen-containing rings such as pyridine with the nitrogen in the 2-, 3-, or 4-position, as well as the various pyrimidine or pyrazole alternatives, as shown in the following coupler formulae.

(VII)

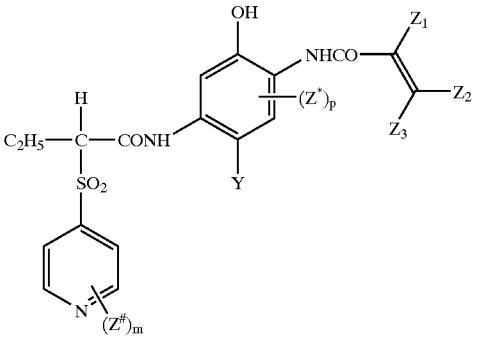

(VIII)

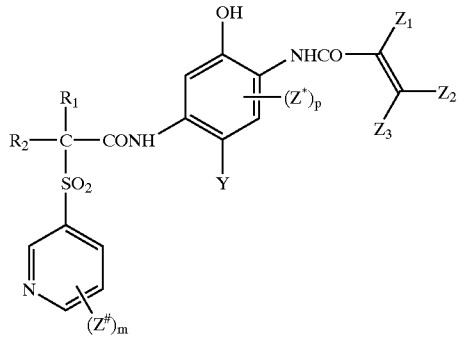

(IX)

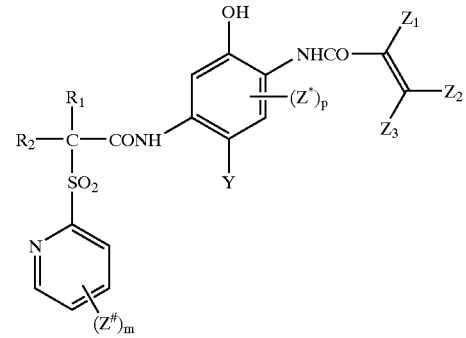

Typically, $R_1$, $R_2$, $R_3$ and $R_4$ contain only a few, if any, aliphatic carbon atoms and the rest of the aliphafic carbon atoms are located in $Z_1$, $Z_2$, $Z_3$, $Z^\#$, $Z^*$. Often the $Z_1$, $Z_2$, $Z_3$, $Z^\#$, or $Z^*$, groups bear an aliphatic carbon number of 12 or more with 15 or 16 being not uncommon.

An embodiment of formula (I) of the invention when $Z_1$, Z2, or $Z_3$ is an alkenyl group is represented by formulae (X)–(XI):

(X)

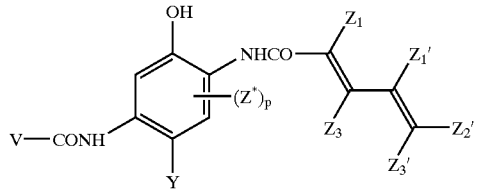

(XI)

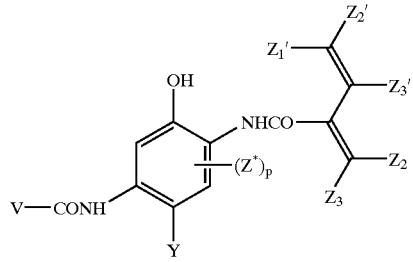

wherein:

$Z_1'$, $Z_2'$, and $Z_3'$ are independently selected groups; and provided that the combined sumn of the aliphatic carbon atoms in V, $Z_1$, $Z_2$, $Z_3$, $Z_1'$, $Z_2'$, $Z_3'$, and all $Z^*$ is at least 8.

The following are examples of couplers useful in the invention.

IC-1
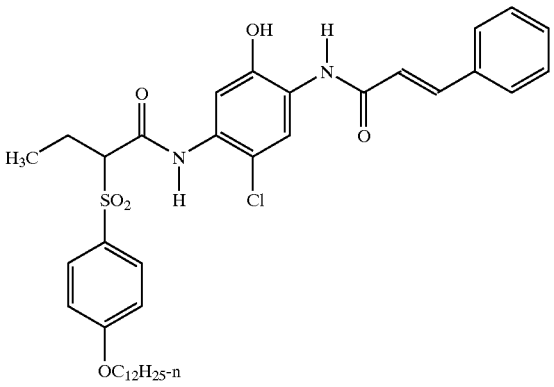
IC-2
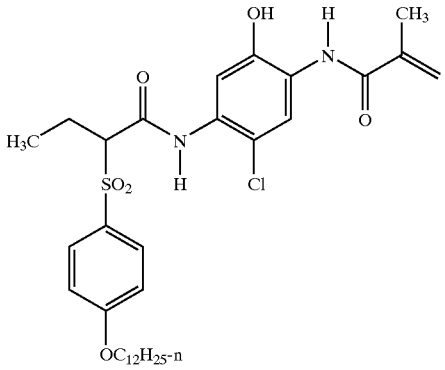
IC-3
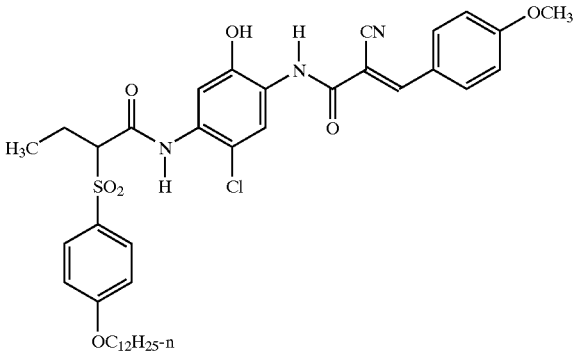
IC-4
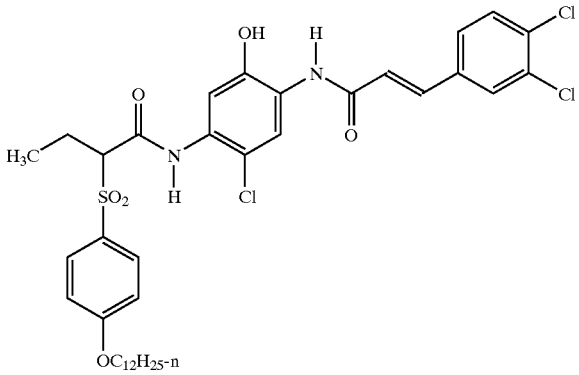
IC-5
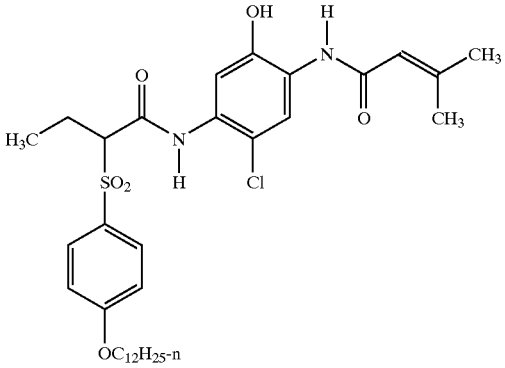
IC-6
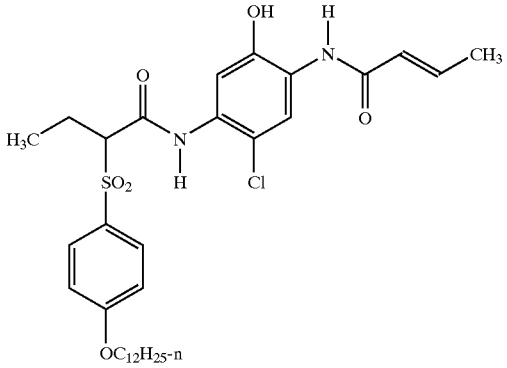
IC-7
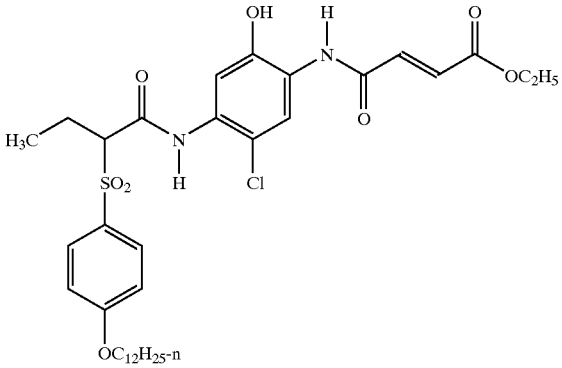
IC-8
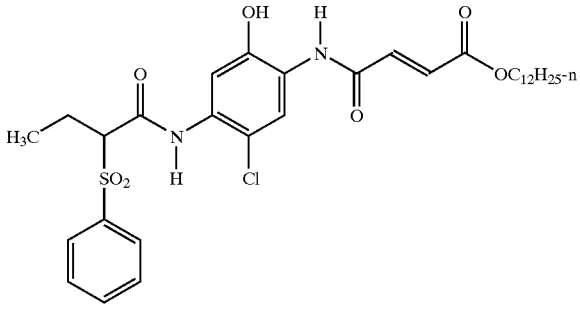

-continued
IC-9
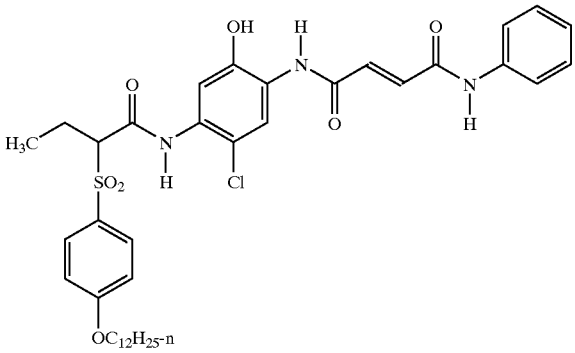
IC-10
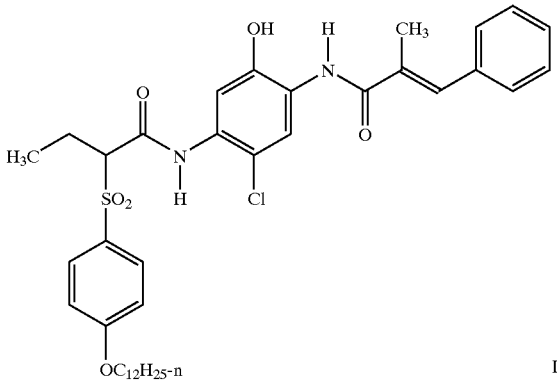
IC-11
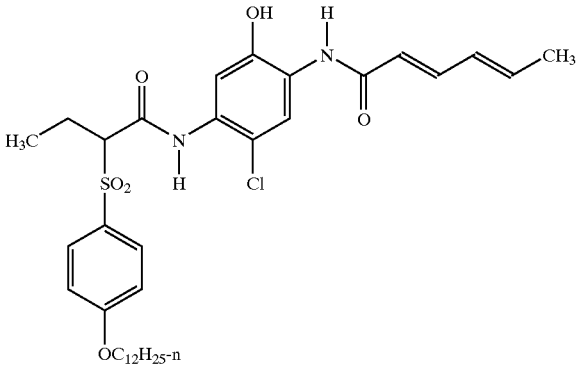
IC-12
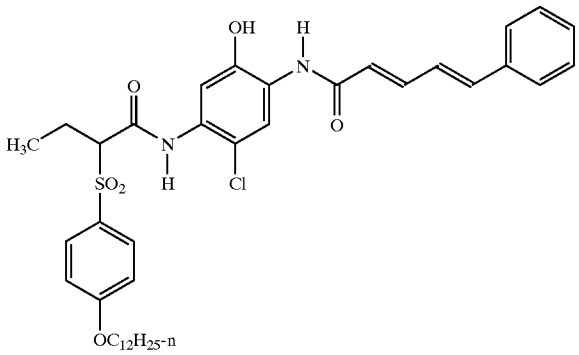
IC-13
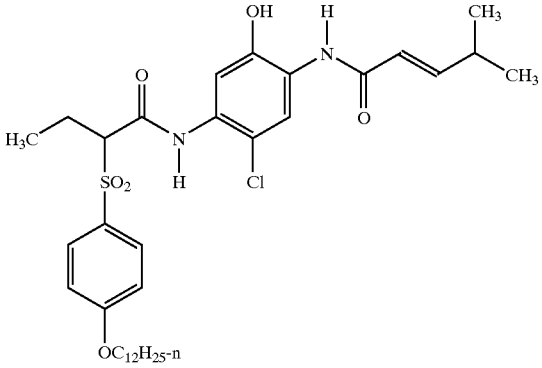
IC-14
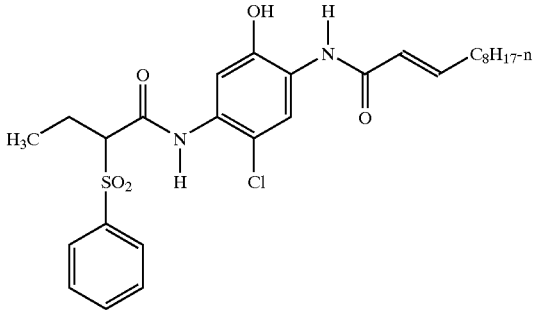
IC-15
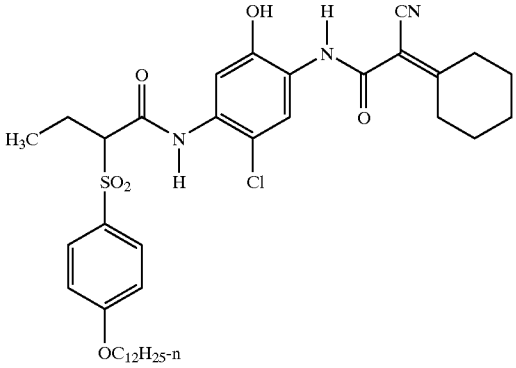
IC-16
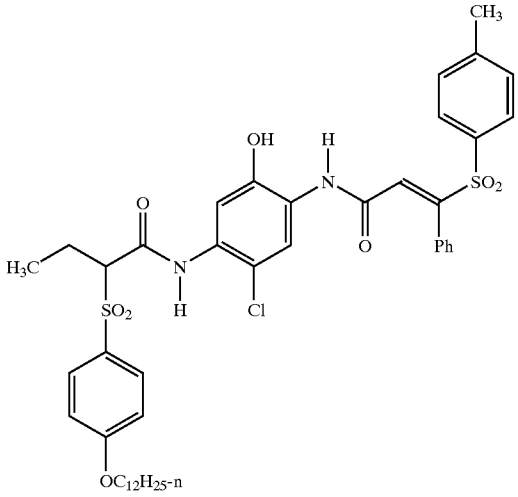

-continued
IC-17
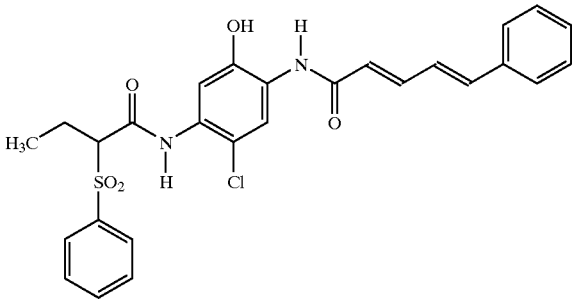
IC-18
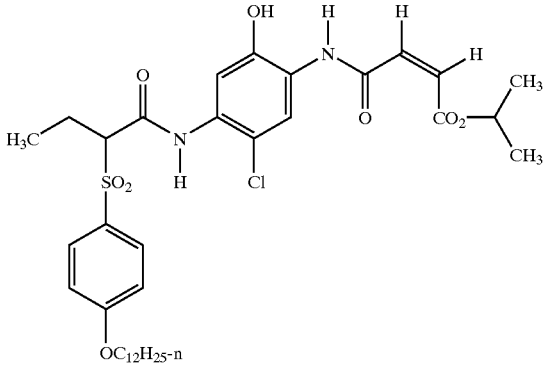
IC-19
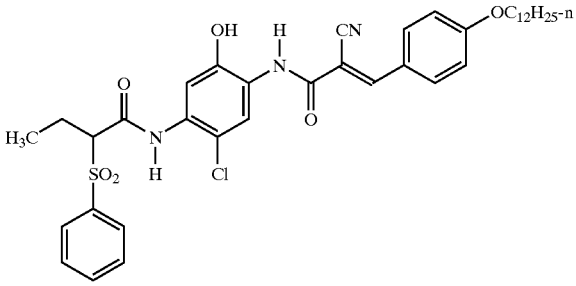
IC-20
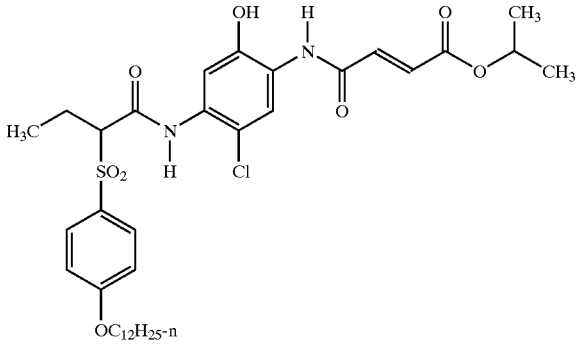
IC-21
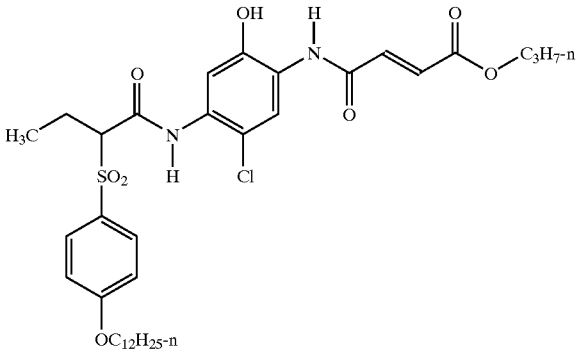
IC-22
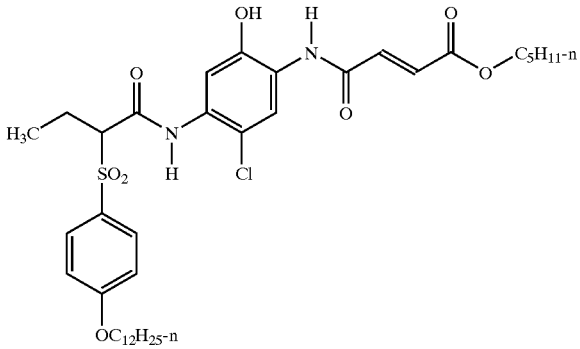
IC-23
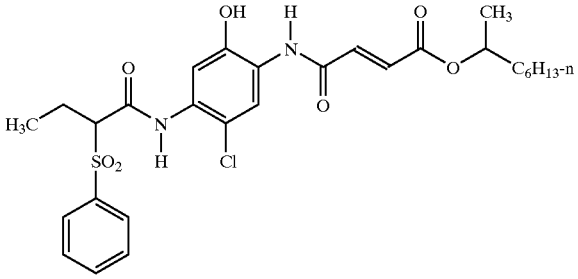
IC-24
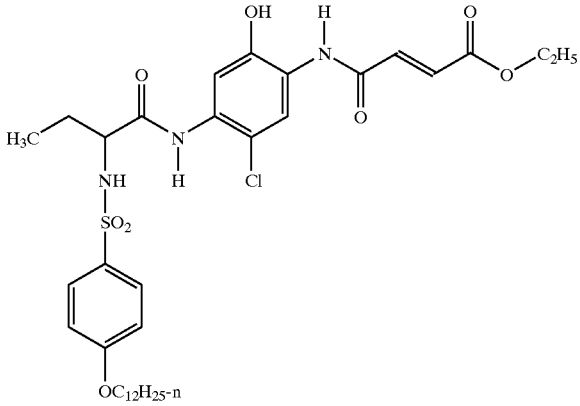

-continued
IC-25
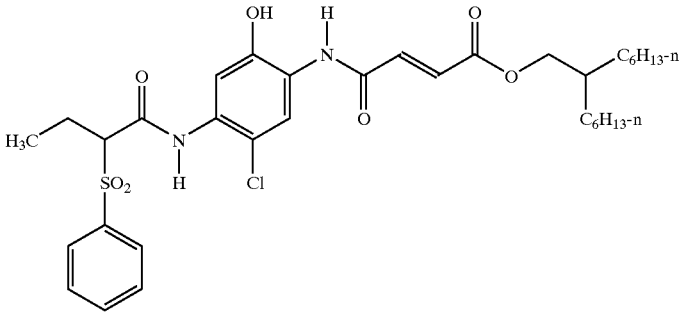
IC-26
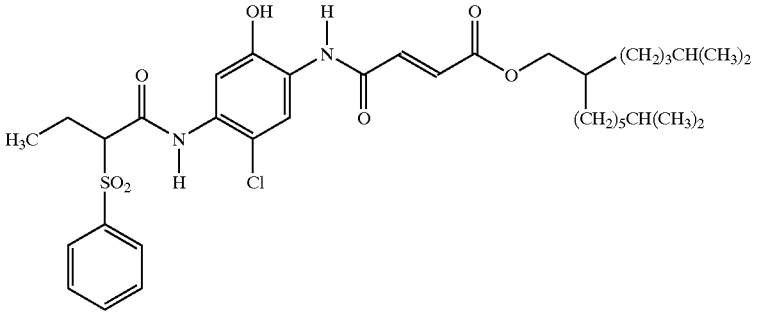
IC-27
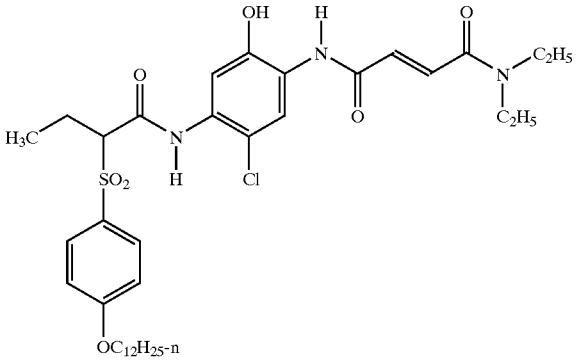
IC-28
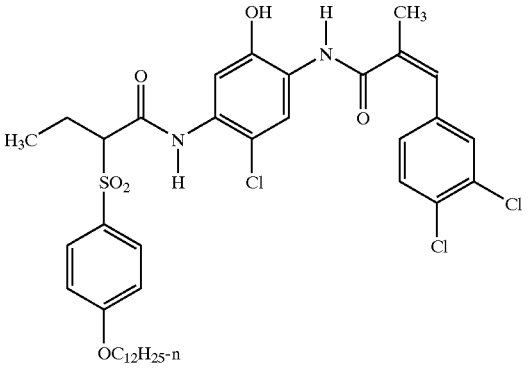
IC-29
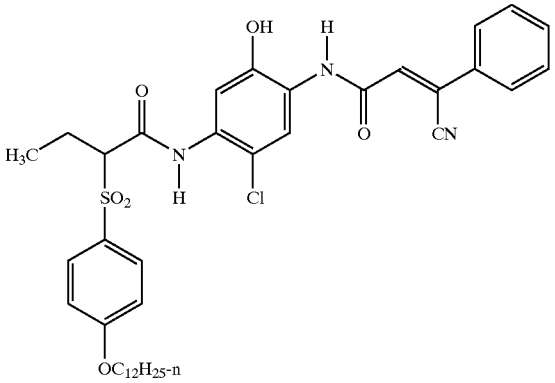
IC-30
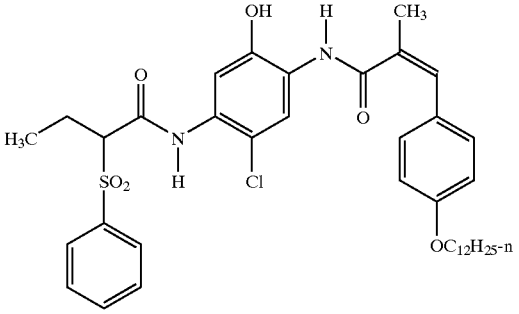

-continued

IC-31

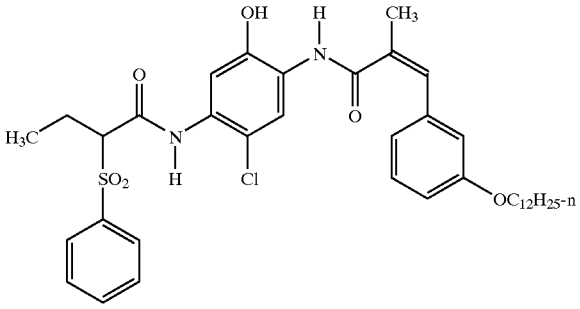

IC-32

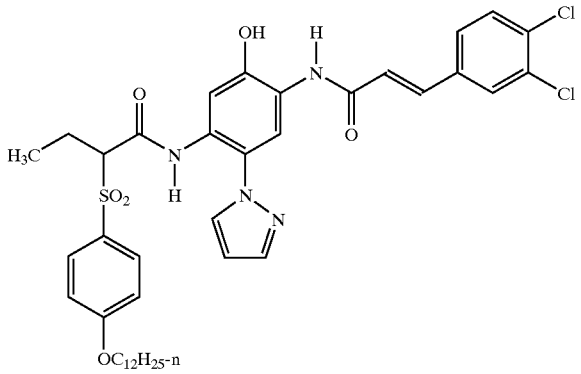

IC-33

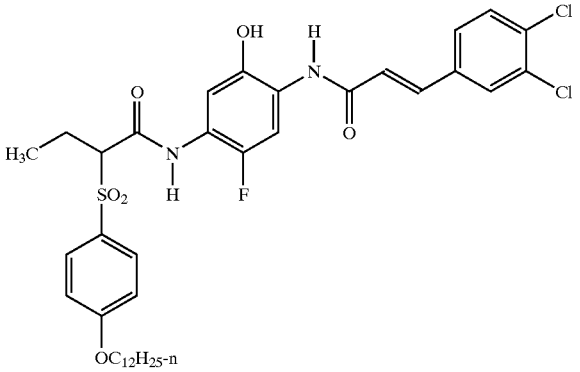

IC-34

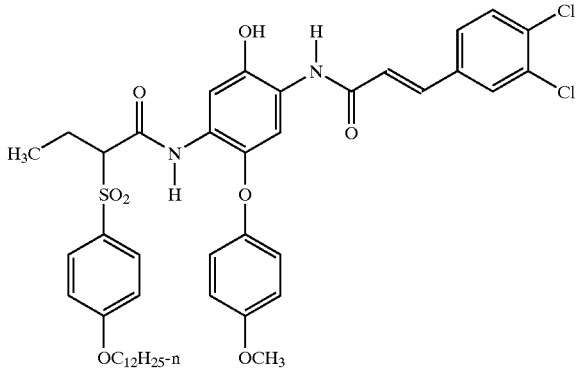

The preferred couplers useful in the invention are capable of forming dyes with color developers such as 4-amino-3-methyl-N-ethyl-N-(2-methanesulfonamidoethyl) aniline sesquisulfate hydrate that have an LBW less than 70 nm and preferably less than 60 nm. The wavelength of maximum absorption is suitably less than 650 nm and is typically less than 640 nm.

The coupler of the invention is preferably an "NB coupler" which is a narrow bandwidth coupler of formula (I) having substituents so that there is a reduction in left bandwidth in spin-coating form vs. solution form of at least 5 nm. In accordance with the procedure, a dye is formed by combining the coupler and the developer 4-amino-3-methyl-N-ethyl-N-(2-methanesulfonamidoethyl) aniline sesquisulfate hydrate. If the left bandwidth (LBW) of its absorption spectra upon "spin coating" of a 3% w/v solution of the dye in di-n-butyl sebacate solvent is at least 5 nm less than the LBW for a solution of the same dye in acetonitrile, then the coupler is an "NB Coupler". The LBW of the spectral curve for a dye is the distance between the left side of the spectral curve and the wavelength of maximum absorption measured at a density of half the maximum.

The "spin coating" sample is prepared by first preparing a 3% w/v solution of the dye in ethyl acetate or other suitable solvent with 3% w/v of di-n-butyl sebacate coupler solvent. If the dye is insoluble, dissolution is achieved by the addition of methylene chloride or tetrahydrofuran. The solution is filtered and 0.1–0.2 ml is applied to a clear polyethylene terephthalate support (approximately 4 cm×4 cm) and spun at 4,000 RPM using the Spin Coating equipment, Model No. EC101, available from Headway Research Inc., Garland Tex. The transmission spectra of the so prepared dye samples are then recorded.

Preferred "NB couplers" form a dye which has a LBW of the absorption spectra upon "spin coating" a sample of the dye in di-n-butyl sebacate at least 5 nm, preferably at least 10 nm, 15 nm or 20 nm, but can fall in the range of between 5 to 40 nm less than that of the same dye in acetonitrile solution.

Unless otherwise specifically stated, use of the term "substituted" or "substituent" means any group or atom other than hydrogen. Additionally, when the term "group" is used, it means that when a substituent group contains a substitutable hydrogen, it is also intended to encompass not only the substituent's unsubstituted form, but also its form further substituted with any substituent group or groups as herein mentioned, so long as the substituent does not destroy properties necessary for photographic utility. Suitably, a substituent group may be halogen or may be bonded to the remainder of the molecule by an atom of carbon, silicon, oxygen, nitrogen, phosphorous, or sulfur. The substituent may be, for example, halogen, such as chlorine, bromine or fluorine; nitro; hydroxyl; cyano; carboxyl; or groups which may be firther substituted, such as alkyl, including straight or branched chain or cyclic alkyl, such as methyl, trifluoromethyl, ethyl, t-butyl, 3-(2,4-di-t-pentylphenoxy) propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy)ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentylphenoxy)acetamido, alpha-(2,4-di-t-pentylphenoxy)

butyramido, alpha-(3-pentadecylphenoxy)-hexanamido, alpha-(4-hydroxy-3-t-butylphenoxy)-tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl) carbonylamino, p-dodecylphenylcarbonylamino, p-tolylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-tolylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-tolylsulfonamido, p-dodecylbenzenesulfonamido, N-methyltetradecylsulfonamido, N,N-dipropylsulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-tolylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-tolylsulfinyl; thio, such as ethylthio, octylthio, benzylthio, tetradecylthio, 2-(2,4-di-t-pentylphenoxy)ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1-(N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-fuiryl, 2-thienyl, 2-benzimidazolyloxy or 2-benzothiazolyl; quaternary ammonium, such as triethylammonium; and silyloxy, such as trimethylsilyloxy.

If desired, the substituents may themselves be firther substituted one or more times with the described substituent groups. The particular substituents used may be selected by those skilled in the art to attain the desired photographic properties for a specific application and can include, for example, hydrophobic groups, solubilizing groups, blocking groups, and releasing or releasable groups. When a molecule may have two or more substituents, the substituents may be joined together to form a ring such as a fused ring unless otherwise provided. Generally, the above groups and substituents thereof may include those having up to 48 carbon atoms, typically 1 to 36 carbon atoms and usually less than 24 carbon atoms, but greater numbers are possible depending on the particular substituents selected.

The materials of the invention can be used in any of the ways and in any of the combinations known in the art. Typically, the invention materials are incorporated in a melt and coated as a layer described herein on a support to form part of a photographic element. When the term "associated" is employed, it signifies that a reactive compound is in or adjacent to a specified layer where, during processing, it is capable of reacting with other components.

To control the migration of various components, it may be desirable to include a high molecular weight hydrophobe or "ballast" group in coupler molecules. Representative ballast groups include substituted or unsubstituted alkyl or aryl groups containing 8 to 48 carbon atoms.

Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido, carbamoyl, alkylsulfonyl, arylsulfonyl, sulfonamido, and sulfamoyl groups wherein the substituents typically contain 1 to 42 carbon atoms. Such substituents can also be further substituted.

The photographic elements can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forning coupler. The element can contain additional layers, such as filter layers, interlayers, overcoat layers, and subbing layers.

If desired, the photographic element can be used in conjunction with an applied magnetic layer as described in *Research Disclosure*, November 1992, Item 34390 published by Kenneth Mason Publications, Ltd., Dudley Annex, 12a North Street, Emsworth, Hampshire P010 7DQ, ENGLAND, and as described in Hatsumi Kyoukai Koukai Gihou No. 94-6023, published Mar. 15, 1994, available from the Japanese Patent Office, the contents of which are incorporated herein by reference. When it is desired to employ the inventive materials in a small format film, *Research Disclosure*, June 1994, Item 36230, provides suitable embodiments.

In the following discussion of suitable materials for use in the emulsions and elements of this invention, reference will be made to *Research Disclosure*, September 1996, Item 38957, available as described above, which is referred to herein by the term "Research Disclosure". The contents of the Research Disclosure, including the patents and publications referenced therein, are incorporated herein by reference, and the Sections hereafter referred to are Sections of the Research Disclosure.

Except as provided, the silver halide emulsion containing elements employed in this invention can be either negative-working or positive-working as indicated by the type of processing instructions (i.e. color negative, reversal, or direct positive processing) provided with the element. Suitable emulsions and their preparation as well as methods of chemical and spectral sensitization are described in Sections I through V. Various additives such as UV dyes, brighteners, antifoggants, stabilizers, light absorbing and scattering materials, and physical property modifying addenda such as hardeners, coating aids, plasticizers, lubricants and matting agents are described, for example, in Sections H and VI through VIII. Color materials are described in Sections X through XIII. Suitable methods for incorporating couplers and dyes, including dispersions in organic solvents, are described in Section X(E). Scan facilitating is described in Section XIV. Supports, exposure, development systems, and processing methods and agents are described in Sections XV to XX. The information contained in the September 1994 *Research Disclosure*, Item No. 36544 referenced above, is updated in the September 1996 *Research* Disclosure, Item No. 38957. Certain desirable photographic elements and processing steps, including those useful in conjunction with color reflective prints, are described in *Research Disclosure*, Item 37038, February 1995.

Coupling-off groups are well known in the art. Such groups can determine the chemical equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, and color correction.

The presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, hetero-oxy, sulfonyloxy, acyloxy, acyl, heterocyclyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169, 3,227,551, 3,432,521, 3,476,563, 3,617,291, 3,880,661, 4,052,212 and 4,134,766; and in UK. Patents and published application Nos. 1,466,728, 1,531,927, 1,533,039, 2,006,755A and 2,017,704A, the disclosures of which are incorporated herein by reference.

Image dye-forming couplers in addition to those of the invention may be included in the element such as couplers that form cyan dyes upon reaction with oxidized color developing agents which are described in such representative patents and publications as: "Farbkuppler-eine Literature Ubersicht," published in Agfa Mitteilungen, Band III, pp. 156–175 (1961) as well as in U.S. Pat. Nos. 2,367,531; 2,423,730; 2,474,293; 2,772,162; 2,895,826; 3,002,836; 3,034,892; 3,041,236; 4,333,999; 4,746,602; 4,753,871; 4,770,988; 4,775,616; 4,818,667; 4,818,672; 4,822,729; 4,839,267; 4,840,883; 4,849,328; 4,865,961; 4,873,183; 4,883,746; 4,900,656; 4,904,575; 4,916,051; 4,921,783; 4,923,791; 4,950,585; 4,971,898; 4,990,436; 4,996,139; 5,008,180; 5,015,565; 5,011,765; 5,011,766; 5,017,467; 5,045,442; 5,051,347; 5,061,613; 5,071,737; 5,075,207; 5,091,297; 5,094,938; 5,104,783; 5,178,993; 5,813,729; 5,187,057; 5,192,651; 5,200,305 5,202,224; 5,206,130; 5,208,141; 5,210,011; 5,215,871; 5,223,386; 5,227,287; 5,256,526; 5,258,270; 5,272,051; 5,306,610; 5,326,682; 5,366,856; 5,378,596; 5,380,638; 5,382,502; 5,384,236; 5,397,691; 5,415,990; 5,434,034; 5,441,863; EPO 0 246 616; EPO 0 250 201; EPO 0 271 323; EPO 0 295 632; EPO 0 307 927; EPO 0 333 185; EPO0 378 898; EPO0 389 817; EPO 0 487 111; EPO 0 488 248; EPO 0 539 034; EPO 0 545 300; EPO 0 556 700; EPO 0 556 777; EPO 0 556 858; EPO 0 569 979; EPO 0 608 133; EPO 0 636 936; EPO 0 651 286; EPO 0 690 344; German OLS 4,026,903; German OLS 3,624,777, and German OLS 3,823,049. Typically such couplers are phenols, naphthols, or pyrazoloazoles.

Couplers that form magenta dyes upon reaction with oxidized color developing agent are described in such representative patents and publications as: "Farbkuppler-eine Literature Ubersicht," published in Agfa Mitteilungen, Band III, pp. 126–156 (1961) as well as U.S. Pat. Nos. 2,311,082 and 2,369,489; 2,343,701; 2,600,788; 2,908,573; 3,062,653; 3,152,896; 3,519,429; 3,758,309; 3,935,015; 4,540,654; 4,745,052; 4,762,775; 4,791,052; 4,812,576; 4,835,094; 4,840,877; 4,845,022; 4,853,319; 4,868,099; 4,865,960; 4,871,652; 4,876,182; 4,892,805; 4,900,657; 4,910,124; 4,914,013; 4,921,968; 4,929,540; 4,933,465; 4,942,116; 4,942,117; 4,942,118; U.S. Pat. No. 4,959,480; 4,968,594; 4,988,614; 4,992,361; 5,002,864; 5,021,325; 5,066,575; 5,068,171; 5,071,739; 5,100,772; 5,110,942; 5,116,990; 5,118,812; 5,134,059; 5,155,016; 5,183,728; 5,234,805; 5,235,058; 5,250,400; 5,254,446; 5,262,292; 5,300,407; 5,302,496; 5,336,593; 5,350,667; 5,395,968; 5,354,826; 5,358,829; 5,368,998; 5,378,587; 5,409,808; 5,411,841; 5,418,123; 5,424,179; EPO 0 257 854; EPO 0 284 240; EPO 0 341 204; EPO 347,235; EPO 365,252; EPO 0 422 595; EPO 0 428 899; EPO 0 428 902; EPO 0 459 331; EPO 0 467 327; EPO 0 476 949; EPO 0487 081; EPO 0 489 333; EPO 0 512 304; EPO 0 515 128; EPO 0 534 703; EPO 0 554 778; EPO 0 558 145; EPO 0 571 959; EPO 0 583 832; EPO 0 583 834; EPO 0 584 793; EPO 0 602 748; EPO 0 602 749; EPO 0 605 918; EPO 0 622 672; EPO 0 622 673; EPO 0 629 912; EPO 0 646 841, EPO 0 656 561; EPO 0 660 177; EPO 0 686 872; WO 90/10253; WO 92/09010; WO 92/10788; WO 92/12464; WO 93/01523; WO 93/02392; WO 93/02393; WO 93/07534; UK Application 2,244,053; Japanese Application 0 3192-350; German OLS 3,624,103; German OLS 3,912,265; and German OLS 40 08 067. Typically such couplers are pyrazolones, pyrazoloazoles, or pyrazolobenzimidazoles that form magenta dyes upon reaction with oxidized color developing agents.

Couplers that form yellow dyes upon reaction with oxidized color developing agent are described in such representative patents and publications as: "Farbkuppler-eine Literature Ubersicht," published in Agfa Mitteilungen; Band III; pp. 112–126 (1961); as well as U.S. Pat. Nos. 2,298,443; 2,407,210; 2,875,057; 3,048,194; 3,265,506; 3,447,928; 4,022,620; 4,443,536; 4,758,501; 4,791,050; 4,824,771; 4,824,773; 4,855,222; 4,978,605; 4,992,360; 4,994,361; 5,021,333; 5,053,325; 5,066,574; 5,066,576; 5,100,773; 5,118,599; 5,143,823; 5,187,055; 5,190,848; 5,213,958; 5,215,877; 5,215,878; 5,217,857; 5,219,716; 5,238,803; 5,283,166; 5,294,531; 5,306,609; 5,328,818; 5,336,591; 5,338,654; 5,358,835; 5,358,838; 5,360,713; 5,362,617; 5,382,506; 5,389,504; 5,399,474; 5,405,737; 5,411,848;

5,427,898; EPO 0 327 976; EPO 0 296 793; EPO 0 365 282; EPO 0 379 309; EPO 0 415 375; EPO 0 437 818; EPO 0 447 969; EPO 0 542 463; EPO 0 568 037; EPO 0 568 196; EPO 0 568 777; EPO 0 570 006; EPO 0 573 761; EPO 0 608 956; EPO 0 608 957; and EPO 0 628 865. Such couplers are typically pen chain ketomethylene compounds.

Couplers that form colorless products upon reaction with oxidized color developing agent are described in such representative patents as: UK. 861,138; U.S. Pat. Nos. 3,632,345; 3,928,041; 3,958,993 and 3,961,959. Typically such couplers are cyclic carbonyl containing compounds that form colorless products on reaction with an oxidized color developing agent.

Couplers that form black dyes upon reaction with oxidized color developing agent are described in such representative patents as U.S. Pat. Nos. 1,939,231; 2,181,944; 2,333,106; and 4,126,461; German OLS No. 2,644,194 and German OLS No. 2,650,764. Typically, such couplers are resorcinols or m-aminophenols that form black or neutral products on reaction with oxidized color developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628, 5,151,343, and 5,234,800.

It may be useful to use a combination of couplers any of which may contain known ballasts or coupling-off groups such as those described in U.S. Pat. No. 4,301,235; U.S. Pat. No. 4,853,319 and U.S. Pat. No. 4,351,897. The coupler may contain solubilizing groups such as'described in U.S. Pat. No. 4,482,629. The coupler may also be used in association with "wrong" colored couplers (e.g. to adjust levels of interlayer correction) and, in color negative applications, with masking couplers such as those described in EP 213.490; Japanese Published Application 58-172,647; U.S. Pat. Nos. 2,983,608; 4,070,191; and 4,273,861; German Applications DE 2,706,117 and DE 2,643,965; UK. Patent 1,530,272; and Japanese Application 58-113935. The masking couplers may be shifted or blocked, if desired.

Typically, couplers are incorporated in a silver halide emulsion layer in a mole ratio to silver of 0.05 to 1.0 and generally 0.1 to 0.5. Usually the couplers are dispersed in a high-boiling organic solvent in a weight ratio of solvent to coupler of 0.1 to 10.0 and typically 0.1 to 2.0 although dispersions using no permanent coupler solvent are sometimes employed.

The invention materials may be used in association with materials that release Photographically Useful Groups (PUGS) that accelerate or otherwise modify the processing steps e.g. of bleaching or fixing to improve the quality of the image. Bleach accelerator releasing couplers such as those described in EP 193,389; EP 301,477; U.S. Pat. No. 4,163,669; U.S. Pat. No. 4,865,956; and U.S. Pat. No. 4,923,784, may be useful. Also contemplated is use of the compositions in association with nucleating agents, development accelerators or their precursors (UK Patent 2,097,140; UK. Patent 2,131,188); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The invention materials may also be used in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. No. 4,420,556; and U.S. Pat. No. 4,543,323.) Also, the compositions may be blocked or coated in protected form as described, for example, in Japanese Application 61/258,249 or U.S. Pat. No. 5,019,492.

The invention materials may further be used in combination with image-modifying compounds that release PUGS such as "Developer Inhibitor-Releasing" compounds (DIR's). DIR's useful in conjunction with the compositions of the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346, 899; 362, 870; 365,252; 365,346; 373,382; 376,212; 377,463; 378,236; 384,670; 396,486; 401,612; 401,613.

Such compounds are also disclosed in "Developer-Inhibitor-Releasing (DIR) Couplers for Color Photography," C. R. Barr, J. R. Thirtle and P. W. Vittum in *Photogaphic Science and Engineering*, Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

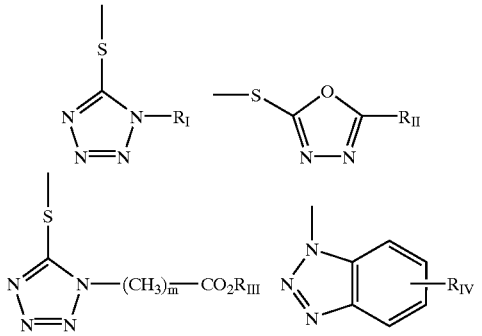

-continued

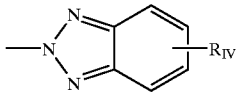

wherein $R_1$ is selected from the group consisting of straight and branched alkyls of from 1 to about 8 carbon atoms, benzyl, phenyl, and alkoxy groups and such groups containing none, one or more than one such substituent; $R_{II}$ is selected from $R_I$ and —$SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —$COOR_V$ and —$NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

A compound such as a coupler may release a PUG directly upon reaction of the compound during processing, or indirectly through a timing or linking group. A timing group produces the time-delayed release of the PUG such groups using an intramolecular nucleophilic substitution reaction (U.S. Pat. No. 4,248,962); groups utilizing an electron transfer reaction along a conjugated system (U.S. Pat. Nos. 4,409,323; 4,421,845; 4,861,701, Japanese Applications 57-188035; 58-98728; 58-209736; 58-209738); groups that fluction as a coupler or reducing agent after the coupler reaction (U.S. Pat. No. 4,438,193; U.S. Pat. No. 4,618,571) and groups that combine the features describe above. It is typical that the timing group is of one of the formulas:

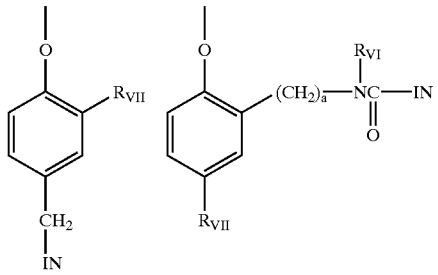

wherein IN is the inhibitor moiety, $R_{VII}$ is selected from the group consisting of nitro, cyano, alkylsulfonyl; sulfamoyl; and sulfonamido groups; a is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

The timing or linking groups may also function by electron transfer down an unconjugated chain. Linking groups are known in the art under various names. Often they have been referred to as groups capable of utilizing a hemiacetal or iminoketal cleavage reaction or as groups capable of utilizing a cleavage reaction due to ester hydrolysis such as U.S. Pat. No. 4,546,073. This electron transfer down an unconjugated chain typically results in a relatively fast decomposition and the production of carbon dioxide, formaldehyde, or other low molecular weight by-products. The groups are exemplified in EP 464,612, EP 523,451, U.S. Pat. No. 4,146,396, Japanese Kokai 60-249148 and 60-249149.

Suitable developer inhibitor-releasing couplers for use in the present invention include, but are not limited to, the following:

D1

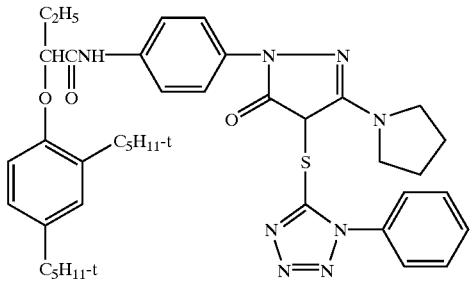

D2

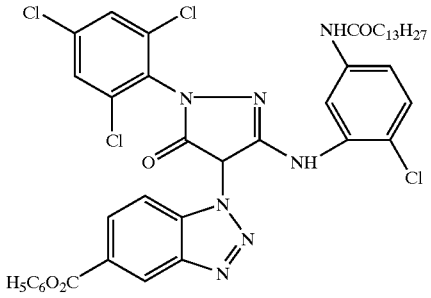

D3

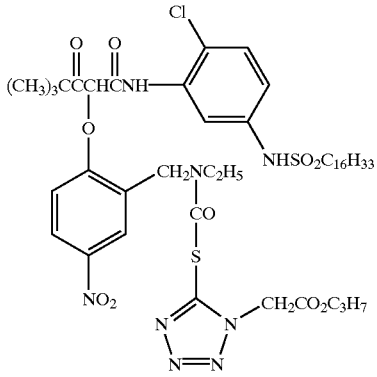

D4

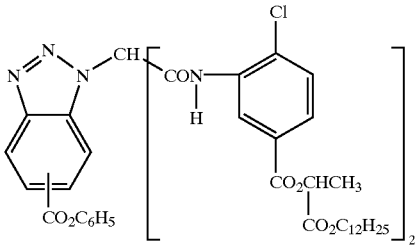

-continued
D5
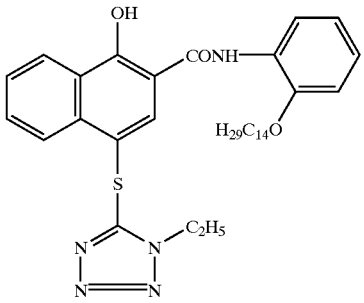
D6
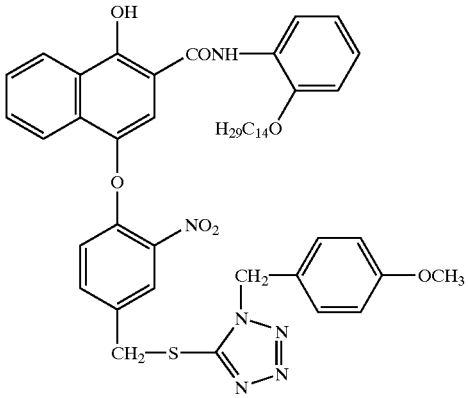
D7
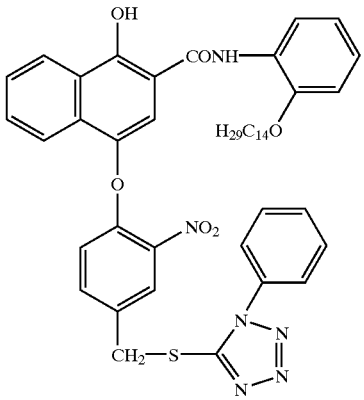
D8
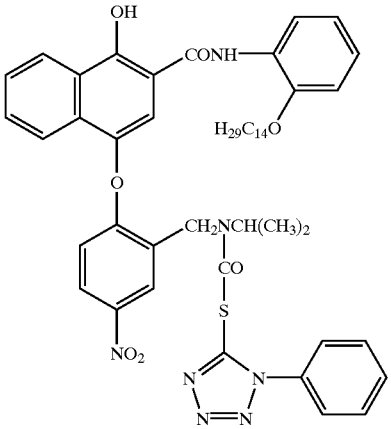
-continued
D9
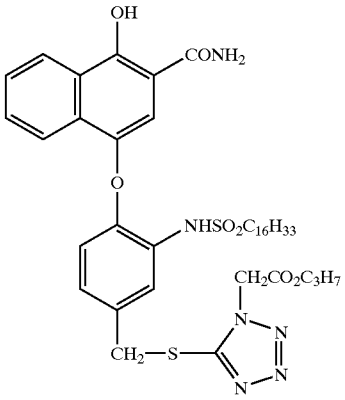
D10
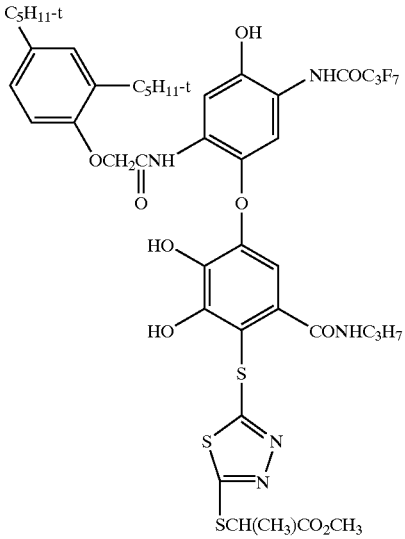
D11
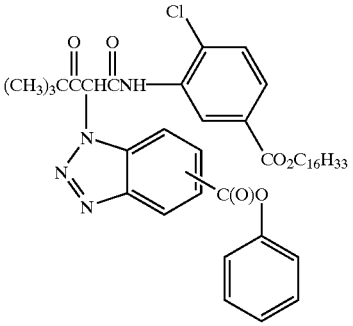
D12
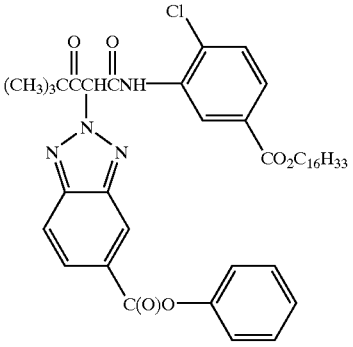

It is also contemplated that the concepts of the present invention may be employed to obtain reflection color prints as described in *Research Disclosure*, November 1979, Item 18716, available from Kenneth Mason Publications, Ltd, Dudley Annex, 12a North Street, Emsworth, Hampshire P0101 7DQ, England, incorporated herein by reference. Materials of the invention may be coated on pH adjusted support as described in U.S. Pat. No. 4,917,994; on a support with reduced oxygen permeability (EP 553,339); with epoxy solvents (EP 164,961); with nickel complex stabilizers (U.S. Pat. No. 4,346,165; U.S. Pat. No. 4,540,653 and U.S. Pat. No. 4,906,559 for example); with ballasted chelating agents such as those in U.S. 4,994,359 to reduce sensitivity to polyvalent cations such as calcium; and with stain reducing compounds such as described in U.S. Pat. No. 5,068,171. Other compounds useful in combination with the invention are disclosed in Japanese Published Applications described in Derwent Abstracts having accession numbers as follows: 90-072,629, 90-072,630; 90-072,631; 90-072,632; 90-072, 633; 90-072,634; 90-077,822; 90-078,229; 90-078,230; 90-079,336; 90-079,337; 90-079,338; 90-079,690; 90-079, 691; 90-080,487; 90-080,488; 90-080,489; 90-080,490; 90-080,491; 90-080,492; 90-080,494; 90-085,928; 90-086, 669; 90-086,670; 90-087,360; 90-087,361; 90-087,362; 90-087,363; 90-087,364; 90-088,097; 90-093,662; 90-093, 663; 90-093,664; 90-093,665; 90-093,666; 90-093,668; 90-094,055; 90-094,056; 90-103,409; 83-62,586; 83-09, 959.

Conventional radiation-sensitive silver halide emulsions can be employed in the practice of this invention. Such emulsions are illustrated by *Research Disclosure*, Item 38755, September 1996, I. Emulsion grains and their preparation.

Especially useful in this invention are tabular grain silver halide emulsions. Tabular grains are those having two parallel major crystal faces and having an aspect ratio of at least 2. The term "aspect ratio" is the ratio of the equivalent circular diameter (ECD) of a grain major face divided by its thickness (t). Tabular grain emulsions are those in which the tabular grains account for at least 50 percent (preferably at least 70 percent and optimally at least 90 percent) of the total grain projected area. Preferred tabular grain emulsions are those in which the average thickness of the tabular grains is less than 0.3 micrometer (preferably thin—that is, less than 0.2 micrometer and most preferably ultrathin—that is, less than 0.07 micrometer). The major faces of the tabular grains can lie in either {111} or {100} crystal planes. The mean ECD of tabular grain emulsions rarely exceeds 10 micrometers and more typically is less than 5 micrometers.

In their most widely used form tabular grain emulsions are high bromide {111} tabular grain emulsions. Such emulsions are illustrated by Kofron et al U.S. Pat. No. 4,439,520, Wilgus et al U.S. Pat. No. 4,434,226, Solberg et al U.S. Pat. No. 4,433,048, Maskasky U.S. Pat. Nos. 4,435, 501, 4,463,087 and 4,173,320, Daubendiek et al U.S. Pat. Nos. 4,414,310 and 4,914,014, Sowinski et al U.S. Pat. No. 4,656,122, Piggin et al U.S. Pat. Nos. 5,061,616 and 5,061, 609, Tsaur et al U.S. Pat. Nos. 5,147,771, '772, '773, 5,171,659 and U.S. Pat. No. 5,252,453, Black et al U.S. Pat. Nos. 5,219,720 and 5,334,495, Delton U.S. Pat. Nos. 5,310, 644, 5,372,927 and 5,460,934, Wen U.S. Pat. No. 5,470,698, Fenton et al U.S. Pat. No. 5,476,760, Eshelman et al U.S. Pat. Nos. 5,612,175 and 5,614,359, and Irving et al U.S. Pat. No. 5,667,954.

Ultrathin high bromide {111} tabular grain emulsions are illustrated by Daubendiek et al U.S. Pat. Nos. 4,672,027, 4,693,964, 5,494,789, 5,503,971 and 5,576,168, Antoniades et al U.S. Pat. No. 5,250,403, Olm et al U.S. Pat. No. 5,503,970, Deaton et al U.S. Pat. No. 5,582,965, and Maskasky U.S. Pat. No 5,667,955.

High bromide {100} tabular grain emulsions are illustrated by Mignot U.S. Pat. Nos. 4,386,156 and 5,386,156.

High chloride {111} tabular grain emulsions are illustrated by Wey U.S. Pat. No. 4,399,215, Wey et al U.S. Pat. No. 4,414,306, Maskasky U.S. Pat. Nos. 4,400,463, 4,713, 323, 5,061,617, 5,178,997, 5,183,732, 5,185,239, 5,399,478 and 5,411,852, and Maskasky et al U.S. Pat. Nos. 5,176,992 and 5,178,998. Ultrathin high chloride { 11I } tabular grain emulsions are illustrated by Maskasky U.S. Pat. Nos. 5,271, 858 and 5,389,509.

High chloride {100} tabular grain emulsions are illustrated by Maskasky U.S. Pat. Nos. 5,264,337, 5,292,632, 5,275,930 and 5,399,477, House et al U.S. Pat. No. 5,320, 938, Brust et al U.S. Pat. No. 5,314,798, Szajewski et al U.S. Pat. No. 5,356,764, Chang et al U.S. Pat. Nos. 5,413,904 and 5,663,041, Oyamada U.S. Pat. No. 5,593,821, Yamashita et al U.S. Pat. Nos. 5,641,620 and 5,652,088, Saitou et al U.S. Pat. No. 5,652,089, and Oyamada et al U.S. Pat. No. 5,665,530. Ultrathin high chloride {100} tabular grain emulsions can be prepared by nucleation in the presence of iodide, following the teaching of House et al and Chang et al, cited above.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent. Tabular grain emulsions of the latter type are illustrated by Evans et al. U.S. Pat. No. 4,504,570.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye. If desired "Redox Amplification" as described in Research Disclosure XVIIIB(5) may be used.

With negative-working silver halide, the processing step described above provides a negative image. One type of such element, referred to as a color negative film, is designed for image capture. Speed (the sensitivity of the element to low light conditions) is usually critical to obtaining sufficient image in such elements. Such elements are typically silver bromoiodide emulsions coated on a transparent support and are sold packaged with instructions to process in known color negative processes such as the Kodak C-41 process as described in The British Journal of Photography Annual of 1988, pages 191–198. If a color negative film element is to be subsequently employed to generate a viewable projection print as for a motion picture, a process such as the Kodak ECN-2 process described in the H-24 Manual available from Eastman Kodak Co. may be employed to provide the color negative image on a transparent support. Color negative development times are typically 3' 15" or less and desirably 90 or even 60 seconds or less.

The photographic element of the invention can be incorporated into exposure structures intended for repeated use or exposure structures intended for limited use, variously referred to by names such as "single use cameras", "lens with film", or "photosensitive material package units".

Another type of color negative element is a color print. Such an element is designed to receive an image optically printed from an image capture color negative element. A color print element may be provided on a reflective support for reflective viewing (e.g. a snap shot) or on a transparent support for projection viewing as in a motion picture. Elements destined for color reflection prints are provided on a reflective support, typically paper, employ silver chloride emulsions, and may be optically printed using the so-called negative-positive process where the element is exposed to light through a color negative film which has been processed as described above. The element is sold packaged with instructions to process using a color negative optical printing process, for example the Kodak RA-4 process, as generally described in PCT WO 87/04534 or U.S. Pat. No. 4,975,357, to form a positive image. Color projection prints may be processed, for example, in accordance with the Kodak ECP-2 process as described in the H-24 Manual. Color print development times are typically 90 seconds or less and desirably 45 or even 30 seconds or less.

A reversal element is capable of forming a positive image without optical printing. To provide a positive (or reversal) image, the color development step is preceded by development with a non-chromogenic developing agent to develop exposed silver halide, but not form dye, and followed by uniformly fogging the element to render unexposed silver halide developable. Such reversal elements are typically sold packaged with instructions to process using a color reversal process such as the Kodak E-6 process as described in The British Journal of Photography Annual of 1988, page 194. Alternatively, a direct positive emulsion can be employed to obtain a positive image.

The above elements are typically sold with instructions to process using the appropriate method such as the mentioned color negative (Kodak C-41), color print (Kodak RA-4), or reversal (Kodak E-6) process.

Preferred color developing agents are p-phenylenediamines such as:

4-amino-N,N-diethylaniline hydrochloride, 4-amino-3-methyl-N,N-diethylaniline hydrochloride, 4-amino-3-methyl-N-ethyl-N-(2-methanesulfonamidoethyl)aniline sesquisulfate hydrate, 4-amino-3-methyl-N-ethyl-N-(2-hydroxyethyl)aniline sulfate, 4-amino-3-(2-methanesulfonamidoethyl)-N,N-diethylaniline hydrochloride, and 4-amino-N-ethyl-N-(2-methoxyethyl)-m-toluidine di-p-toluene sulfonic acid.

Development is usually followed by the conventional steps of bleaching, fixing, or bleach-fixing, to remove silver or silver halide, washing, and drying The compound of the invention is a coupler compound as described in the foregoing description of the photographic element. The process of the invention includes a method of forming an image in the described silver halide element after the same has been exposed to light comprising contacting the exposed element with a color developing compound such as a para phenylene diamine.

A direct-view photographic element is defined as one which yields a color image that is designed to be viewed directly (1) by reflected light, such as a photographic paper print, (2) by transmitted light, such as a display transparency, or (3) by projection, such as a color slide or a motion picture print. These direct-view elements may be exposed and processed in a variety of ways. For example, paper prints, display transparencies, and motion picture prints are typically produced by optically printing an image from a color negative onto the direct-viewing element and processing though an appropriate negative-working photographic process to give a positive color image. Color slides may be produced in a similar manner but are more typically produced by exposing the film directly in a camera and processing through a reversal color process or a direct positive process to give a positive color image. The image may also be produced by alternative processes such as digital printing.

Each of these types of photographic elements has its own particular requirements for dye hue, but in general they all require cyan dyes that whose absorption bands are less deeply absorbing (that is, shifted away from the red end of the spectrum) than color negative films. This is because dyes in direct viewing elements are selected to have the best appearance when viewed by human eyes, whereas the dyes in color negative materials designed for optical printing are designed to best match the spectral sensitivities of the print materials.

The compound of the invention is the coupler compound as described in the foregoing description of the photographic element. The process of the invention includes a method of forming an image in the described silver halide element after the same has been exposed to light comprising contacting the exposed element with a color developing compound such as a para phenylene diamine.

Synthesis Example

The following is an example of how couplers useful in the invention may be synthesized.

Scheme

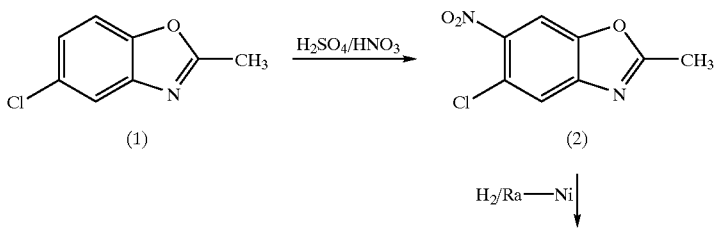

-continued

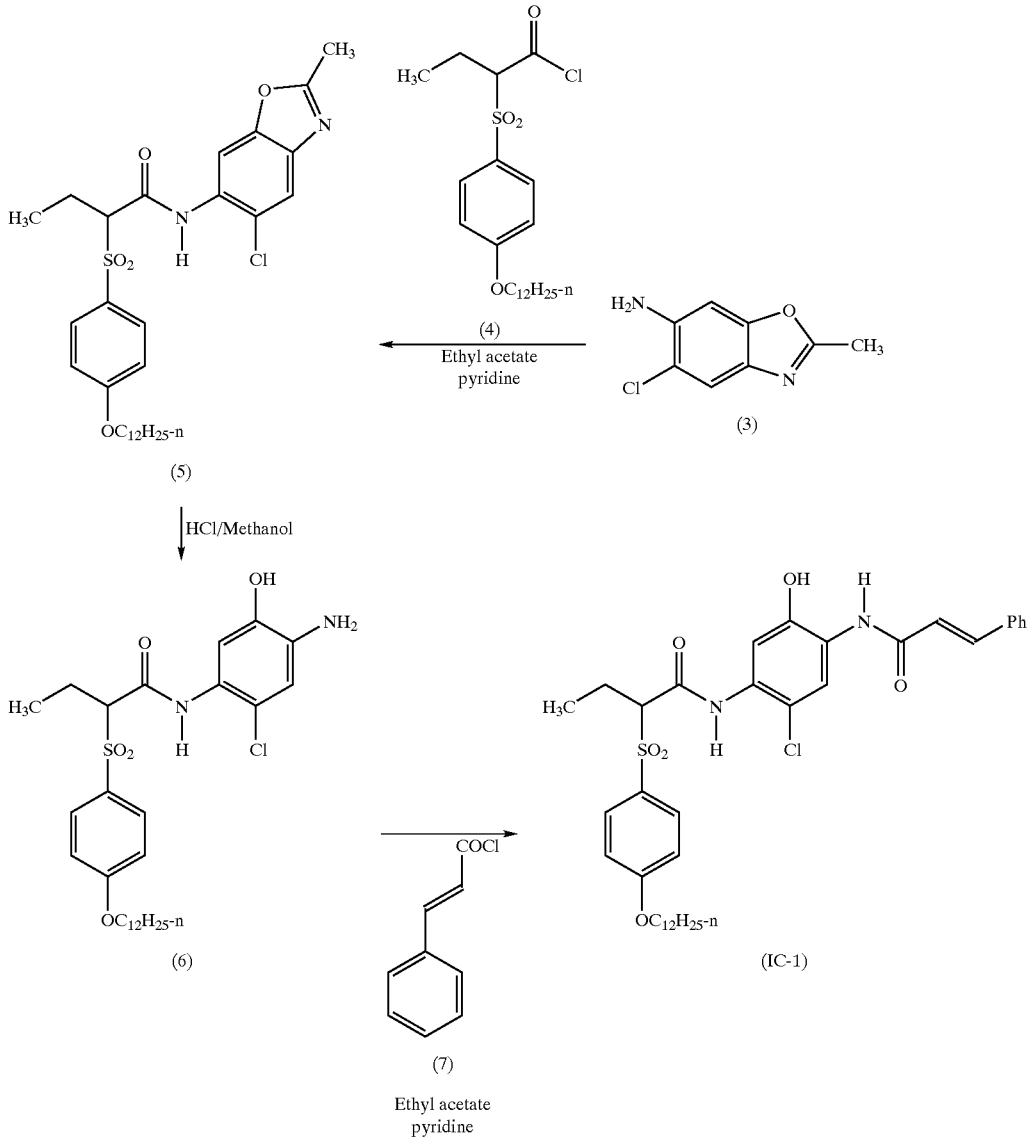

5-Chloro-2-methyl-6-nitrobenzoxazole (2)

Concentrated sulfuric acid (150 mL) was stirred mechanically and cooled in an ice/water bath. To this was gradually added 5-chloro-2-methylbenzoxazole (1), (75 g, 0.45 Moles), at such a rate that the temperature stayed at 30° C., over a 15–20 minute period. A solution of concentrated sulfuric acid (40 mL), and concentrated nitric acid (32 mL), was prepared and added drop by drop to the benzoxazole solution at such a rate that the temperature was maintained at approximately 20° C. When this acid solution had been added the cooling bath was removed and the mixture allowed to stir at room temperature for 1 hour. At the end of this period the solution was carefully poured onto ice with good stirning. Sufficient water was then added to get good mixing. The solid was filtered off, washed well with water followed by methanol and finally air dried. Yield 90.6 g 6-Amino-5-Chloro-2-methylbenzoxazole (3)

Compound (2), (30 g), was dissolved in tetrahydrofuran (150 mL), and Raney-Nickel which had been pre-washed with water (×3) and tetrahydrofuran (×3), was added. The mixture was then hydrogenated at room temperature and 50 psi of hydrogen. The reaction is complete in approximately 1.5 hours. After this period, the catalyst is filtered off and the solution concentrated under reduced pressure. The residue is triturated with heptane, cooled and the solid filtered off. Yield 22 g.

2-[(4-Dodecyloxyphenyl)sulfonyl]butanoyl Chloride, (4).

2-[(3-Dodecyloxyphenyl)sulfonyl]butanoic acid (79.6 g, 0.193 Mole) was suspended in ethyl acetate (700 mL) to which was added dimethylformamide (1.0 mL) and thionyl chloride (70 mL, 0.964 Mole). The mixture was heated at 70° C. for 1.5 hours, cooled, concentrated under reduced pressure, co-evaporated with ethyl acetate (2×100 mL) and the oil so obtained used as such in the next step of the reaction sequence.

Compound (5).

6-Amino-5-Chloro-2-methylbenzoxazole (3), (32.0 g, 0.175 Mole) was dissolved in ethyl acetate (500 mL) with dry pyridine (15.6 mL, 0.193 Mole). The 2-[(4-dodecyloxyphenyl)sulfonyl]butanoyl chloride (4), (0.193 Mole) dissolved in ethyl acetate (200 mL) was then added to the solution at a fairly fast drip rate over a 15 minute period while maintaining good stirring and keeping the temperature below 10–15° C. At the end of the addition, the cooling bath was removed and the reaction mixture stirred at room temperature for an additional 15 minutes. The reaction mixture was then washed with 2N—HCl (3×200 mL), dried ($MgSO_4$), filtered and concentrated to an oil. This oil was then taken on to the next step.

Compound (6).

Compound (5), (0.175 Mole) was dissolved in methanol (800 mL) and concentrated hydrochloric acid (40 mL) added. The mixture was heated to 70° C. and after about 10 minutes complete dissolution of the initially precipitated material was achieved. After 1 hour a further volume of concentrated hydrochloric acid (20 mL) was added followed by 2 additional volumes (20 mL each) at 30 minute intervals. After the last volume had been added, the solution was heated for 30 more minutes, cooled and concentrated under reduced pressure until the product began to crystallize. Diethyl ether (1.0 L) was added and the mixture cooled overnight to 0°C. Following morning the product was filtered off washed with diethyl ether, and air-dried. Yield 10 g.

Inventive Coupler (IC-1).

The hydrochloride salt of compound (6) (3.0 g, 5.09 mMole), was dissolved in tetrahydrofuran (30 mL) and dry pyridine (1.0 mL, 12.21 mMole) added. If necessary, the mixture can be heated gently to achieve complete dissolution. Cinnamoyl chloride (7), (1.02 g, 6.10 mMole) dissolved in tetrahydrofuran (10 mL) was added drop by drop and the resulting mixture stirred at room temperature for 15 minutes. The mixture was diluted with ethyl acetate and the ethyl acetate washed with 2N-hydrochloric acid, dried ($MgSO_4$), filtered and concentrated to an oil under reduced pressure. This oil was subjected to flash chromatography over silica gel eluting with 30%-ethyl acetate in heptane yielding Inventive Coupler (IC-1), 3.0 g.

Dye Property Examples

Using procedures known to those skilled in synthetic chemistry, such as described in J. Bailey, JCS Perkin 1,1977, 2047, the dyes of the couplers in Table 1 below were prepared by coupling with 4-amino-3-methyl-N-ethyl-N-(2-methane-sulfonamidoethyl) aniline sesquisulfate hydrate, and then purified by either crystallization or chromatographic techniques.

A 3% w/v solution of di-n-butyl sebacate was made with ethyl acetate and from this solution a 3% solution of the dye was prepared. If the dye was insoluble, dissolution was achieved by either the addition of methylene chloride or tetrahydrofuran, or tetrahydrofuran was used as the sole solvent. The solution was filtered and 0.1–0.2 mL was applied to a clear polyethylene-terephthalate support (approximately 4 cm×4 cm) and spun at 4,000 RPM using the Spin-Coating equipment, Model No. EC101, available from Headway Research Inc., Garland Tex. The transmission spectra of the so-prepared dye samples were then recorded. The transmission spectra of the same dye as a solution of the dye in acetonitrile was also measured for comparison purposes.

The $\lambda_{max}$ values, "half bandwidth" (HBW), and "left bandwidth" (LBW) values for each spectrum is reported in Table 1 below. The wavelength of maximum absorption was recorded as the $\lambda_{max}$. The half bandwidth (HBW) was obtained by subtracting the wavelength at the point where the density is half the value of the maximum density on the left side (short wavelength) of the absorption band from the wavelength at the point on the right side (long wavelength) of the absorption band where the density is half the value of the maximum density. The left bandwidth (LBW) was obtained by subtracting the wavelength at the point on the left side (short wavelength) of the absorption band where the density is half the value of the maximum density from the wavelength of maximum density.

In solution, all of the dyes (invention and comparison) have similar LBW values ranging from 63–66 nm. Upon spin-coating, the LBW values of the dyes of the invention IC-1–IC-3, IC-5–IC-12, IC-14–IC-16, IC-24 and IC-28 are 28–42 nm less than the LBW values of the same dyes in solution. These couplers therefore meet the criterion defined for "NB couplers". The spin-coating LBW values for the dyes from comparison couplers CC-1 and CC-2 are different from the solution LBW values by only 1 nm. Therefore comparison couplers are not "NB couplers". Table 1 shows the results of testing.

TABLE 1

Spin Coating (SC), and acetonitrile solution (Soln.) Data (nm)

| Dye | $\lambda_{max}$ (Soln.) | $\lambda_{max}$ (SC) | HBW (Soln.) | HBW (SC) | LBW (Soln.) | LBW (SC) | Difference = LBW (Soln.) – LBW (SC) |
|---|---|---|---|---|---|---|---|
| CC-1 | 628 | 631 | 121 | 126 | 63 | 62 | 1 |
| CC-2 | 626 | 634 | 124 | 126 | 64 | 63 | 1 |
| IC-1 | 617 | 607 | 123 | 72 | 65 | 35 | 30 |
| IC-2 | 615 | 605 | 124 | 75 | 64 | 36 | 28 |
| IC-3 | 630 | 568 | 124 | 63 | 65 | 23 | 42 |
| IC-5 | 612 | 588 | 125 | 74 | 66 | 35 | 31 |
| IC-6 | 613 | 618 | 124 | 77 | 66 | 37 | 29 |
| IC-7 | 622 | 625 | 124 | 74 | 65 | 35 | 30 |
| IC-8 | 621 | 619 | 124 | 76 | 65 | 36 | 29 |
| IC-9 | 620 | 588 | 122 | 79 | 63 | 34 | 29 |
| IC-10 | 617 | 609 | 124 | 74 | 65 | 36 | 29 |
| IC-11 | 616 | 621 | 124 | 75 | 66 | 37 | 29 |
| IC-12 | 617 | 608 | 125 | 74 | 66 | 35 | 31 |
| IC-14 | 614 | 603 | 125 | 75 | 66 | 34 | 32 |
| IC-15 | 622 | 604 | 124 | 77 | 65 | 35 | 30 |
| IC-16 | 622 | 614 | 125 | 79 | 65 | 36 | 29 |
| IC-24 | 620 | 623 | 124 | 70 | 66 | 33 | 33 |
| IC-28 | 620 | 624 | 124 | 75 | 67 | 38 | 29 |

CC-1

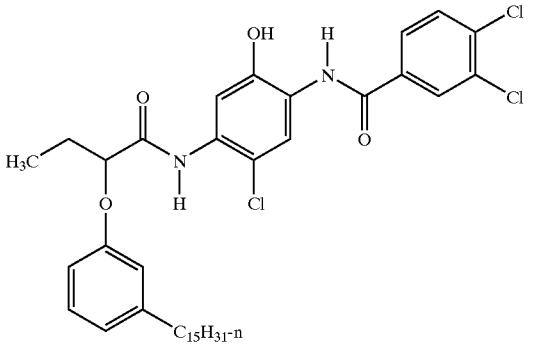

-continued

CC-2

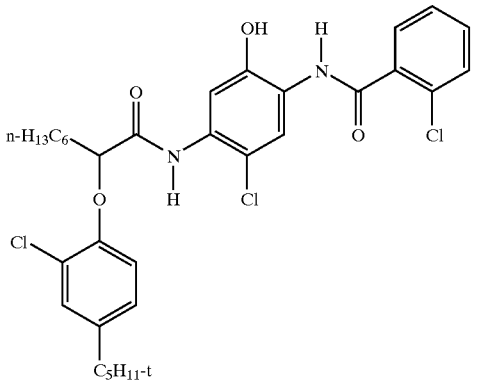

Photograiphic Examples

Dispersion Preparations

Method 1. A dispersion was prepared by combining a solution containing 0.75 g of coupler C-1, 0.645 g of UV absorber, UV-1, 0.735 g of solvent S-1, and 0.06 g of solvent S-3 with a solution containing 1.41 g of decalcified gelatin 1.41 g of a 10% solution of surfactant Alkanol XC (trademark of E.I. Dupont Co.), and demineralized water to give a total weight of 28.1 g. The combined solution was mixed for one minute at 8000 rpm using a Brinkmann rotor-stator mixer, then homogenized using ultrasonic agitation (Bronson Sonifier 250) for 3.5 minutes.

Method 2. Dispersions were prepared by combining a solution containing 0.75 g of coupler as indicated in the Table 2, an amount of UV absorber, UV-I equal to 1.5 molar equivalents of the coupler being dispersed, 0.75 g of solvent S-2, and 2.25 g of ethyl acetate with a solution containing 1.41 g of decalcified gelatin, 1.41 g of a 10% solution of surfactant Alkanol XC (trademark of E.I. Dupont Co.), and demineralized water to give a total weight of 28.1 g. The combined solution was mixed for one minute at 8000 rpm using a Brinkmann rotor-stator mixer, then homogenized using ultrasonic agitation (Bronson Sonifier 250) for 3.5 minutes.

All dispersions were placed in cold storage until ready for combination with a light-sensitive photographic emulsion in a photographic element.

Coating Evaluation

Photographic elements were prepared by using dispersions prepared by the above methods coated in the following format on gel-subbed, polyethylene-coated paper support.

First Layer

An underlayer containing 3.23 g gelatin per square meter

Second Layer

A photosensitive layer containing (per square meter) 2.15 g of gelatin, an amount of red-sensitized silver chloride emulsion to coat 0.194 g silver; an amount of dispersion from method 1 containing $8.61\times10^{-4}$ mole of coupler; and 43 mg of Alkanol XC added as a coating aid.

Dispersions made by method 2 were coated in the same way except that the coupler amount was reduced to $5.63\times10^{-4}$ moles.

Third Layer

A layer containing 1.40 g gelatin (per square meter), 0.14 g bis(vinylsulfonyl)methane ether, 43 mg Alkanol XC, and 4.41 mg tetraethylammonium perfluorooctanesulfonate.

The control couplers, coupler solvents and other chemicals used are as follows:

C-1

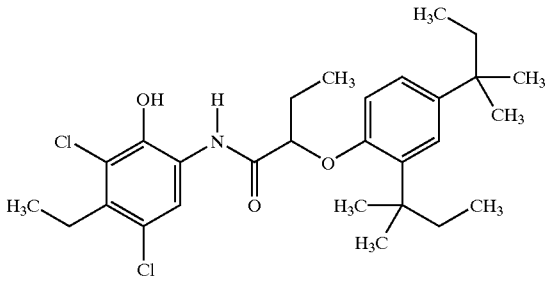

C-2

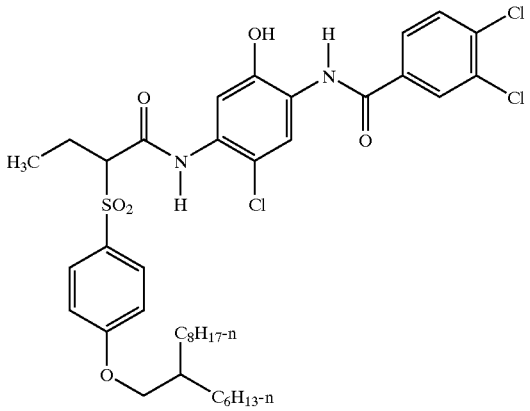

C-3

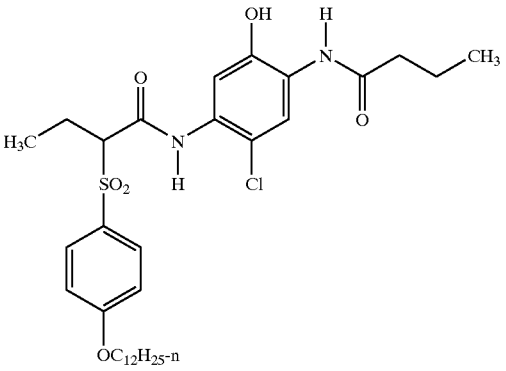

C-4

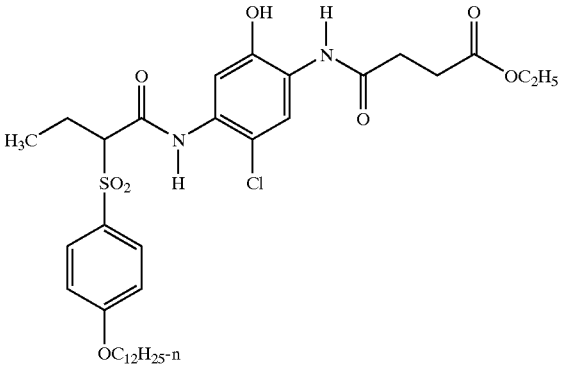

S-1

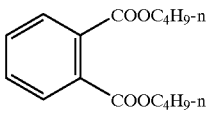

-continued

S-2

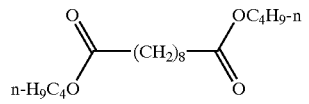

S-3

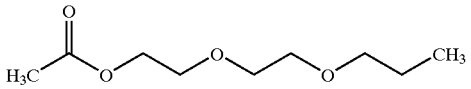

UV-1

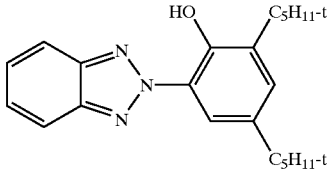

Preparation of Processed Photographic Examples

Processed samples were prepared by exposing the coatings through a step wedge and processing as follows:

| Process Step | Time (min.) | Temp. (° C.) |
|---|---|---|
| Developer | 0.75 | 35.0 |
| Bleach-Fix | 0.75 | 35.0 |
| Water wash | 1.50 | 35.0 |

The processing solutions used in the above process had the following compositions (amounts per liter of solution):

| Developer | |
|---|---|
| Triethanolamine | 12.41 g |
| Blankophor REU (trademark of Mobay Corp.) | 2.30 g |
| Lithium polystyrene sulfonate | 0.09 g |
| N,N-Diethylhydroxylamine | 4.59 g |
| Lithium sulfate | 2.70 g |
| Developing agent Dev-1 | 5.00 g |
| 1-Hydroxyethyl-1, 1-diphosphonic acid | 0.49 g |
| Potassium carbonate, anhydrous | 21.16 g |
| Potassium chloride | 1.60 g |
| Potassium bromide | 7.00 mg |
| pH adjusted to 10.4 at 26.7° C. | |
| **Bleach-Fix** | |
| Solution of ammonium thiosulfate | 71.85 g |
| Ammonium sulfite | 5.10 g |
| Sodium metabisulfite | 10.00 g |
| Acetic acid | 10.20 g |
| Ammonium ferric ethylenediaminetetraacetate | 48.58 g |
| Ethylenediaminetetraacetic acid | 3.86 g |
| pH adjusted to 6.7 at 26.7° C. | |

Dev-1

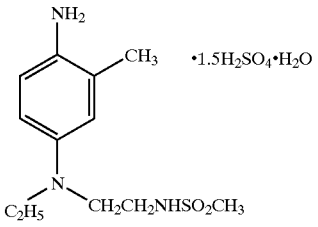

The spectra of the resulting dyes were measured and normalized to a maximum absorption of 1.00. The wavelength of maximum absorption was recorded as the "$\lambda_{max}$." As a measure of the sharpness of the curve on the left (short wavelength) side of the absorption band the "left bandwidth" (LBW) was obtained by subtracting the wavelength at the point on the left side of the absorption band where the normalized density is 0.50 from the $\lambda_{max}$. A lower value of LBW indicates a reduction in the unwanted green absorption and is thus desirable. The $\lambda_{max}$ and LBW values are shown in Table 2.

TABLE 2

Photographic Data

| Comparison or Invention | Coupler | Dispersion Method | $\lambda_{max}$ nm | LBW nm |
|---|---|---|---|---|
| Comparison | C-1* | 1** | 661 | 85 |
| Comparison | C-2 | 2 | 633 | 51 |
| Comparison | C-3 | 2 | 617 | 53 |
| Comparison | C-4 | 2 | 622 | 62 |
| Invention | IC-1 | 2 | 618 | 43 |
| Invention | IC-4 | 2 | 626 | 48 |
| Invention | IC-10 | 2 | 623 | 46 |
| Invention | IC-11 | 2 | 624 | 50 |
| Invention | IC-12 | 2 | 602 | 32 |
| Invention | IC-22 | 2 | 612 | 47 |
| Invention | IC-28 | 2 | 628 | 48 |
| Invention | IC-31 | 2 | 621 | 49 |

*Coupler C-1 was selected because this is a typical phenolic coupler found in the photographic industry.
**Dispersion method 1 was employed for coupler C-1 due to the different chemical and physical properties between this coupler and the others.

It can be seen from Table 2 that the couplers of the invention give superior dyes when compared to the dyes of the comparison couplers, C-1, C-2, C-3 and C-4. Comparison coupler C-1 was selected because this is a typical coupler found in the photographic industry. Comparison coupler C-2 was selected because this gives a typical narrow bandwidth dye. Comparison coupler C-3 and C-4 were selected because they are identical in all respects to the couplers of the invention except that they do not possess the alkenyl group of the invention and hence do not fall under the scope of the invention. The couplers of the invention give dyes, which are hypsochromic (shifted towards the blue region of the spectrum) when compared to the dyes from C-1 and C-2. The comparison couplers yield dyes, which have LBW values ranging from 51–85 nm whereas the couplers of the invention yield dyes, which have LBW values ranging from 32–50 nm. The narrower LBW dyes of the couplers of the invention have thus sharper absorptions on the left side of the absorption band and thus have less unwanted green absorption. Couplers of the invention are desirable because they give brighter colors.

The entire contents of the various patents and other publications referred to in this specification are incorporated herein by reference.

What is claimed is:

1. A photographic element comprising a light-sensitive silver halide emulsion layer having associated therewith a cyan "NB coupler" having the formula:

(I)

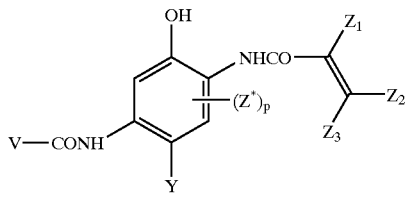

wherein:

the term "NB coupler" represents a coupler of formula (I) that forms a dye with the developer 4-amino-3-methyl-N-ethyl-N-(2-methanesulfonamidoethyl) aniline sesquisulfate hydrate for which the left bandwidth (LBW) using spin-coating is at least Snm less than that of the same dye in solution form;

V is a sulfone, sulfoxide or sulfonamide-containing group;

Y is H or a coupling-off group;

each $Z_1$, $Z_2$, $Z_3$ and $Z^*$ are an independently selected substituent group where p is 0 to 2;

provided that $Z_1$ and $Z_2$ or $Z_2$ and $Z_3$ can join to form a ring;

provided further that $Z_1$ and $Z_2$ do not join to form an aromatic or heterocyclic ring; and provided firther that the combined sum of the aliphatic carbon atoms in V, all $Z_1$, $Z_2$, $Z_3$ and all $Z^*$ is at least 8.

2. The element of claim 1 wherein the coupler is represented by formula (II):

(II)

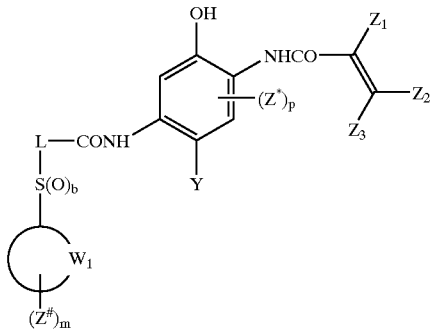

wherein:

L is a linking group;

b is 1 or 2;

each $Z^\#$ is an independently selected substituent group where m is 0 to 5;

$W_1$ represents the atoms necessary to complete a heterocyclic or carbocyclic ring group; and provided that the combined sum of the aliphatic carbon atoms in L, $Z_1$, $Z_2$, $Z_3$, all $Z^*$, and all $Z^\#$ is at least 8.

3. The element of claim 2 wherein the coupler is represented by formula (III):

(III)

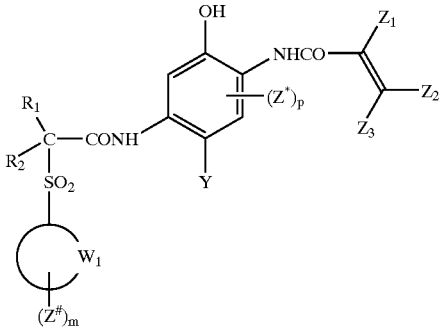

wherein:

$R_1$ and $R_2$ are independently hydrogen, aryl or an alkyl group of 1 to 5 carbon atoms; and provided that the combined sum of the aliphatic carbon atoms in $Z_1$, $Z_2$, $Z_3$, all $Z^*$, all $Z^\#$, $R_1$ and $R_2$ is at least 8.

4. The element of claim 2 wherein the coupler is represented by formula (IV):

(IV)

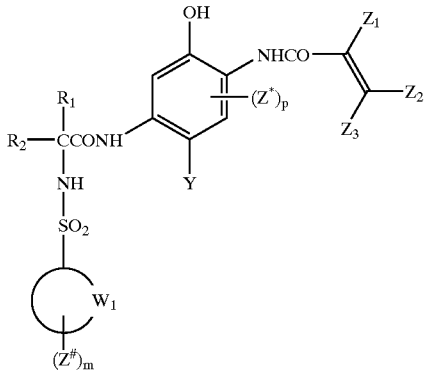

wherein:

$R_1$ and $R_2$ are independently hydrogen, aryl or an alkyl group of 1 to 5 carbon atoms; and provided that the combined sum of the aliphatic carbon atoms in $Z_1$, $Z_2$, $Z_3$, all $Z^*$, all $Z^\#$, $R_1$ and $R_2$ is at least 8.

5. The element of claim 2 wherein the coupler is represented by formula (V):

(V)

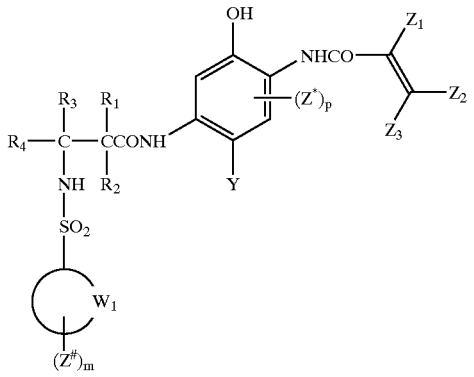

wherein:

$R_1$, $R_2$, $R_3$ and $R_4$ are independently hydrogen, aryl or an alkyl group of 1 to 5 carbon atoms; and provided that the combined sum of the aliphatic carbon atoms in $Z_1$, $Z_2$, $Z_3$, all $Z^*$, all $Z^\#$, $R_1$, $R_2$, $R_3$ and $R_4$ is at least 8.

6. The element of claim 3 where the coupler is represented by formula (VI):

(VI)

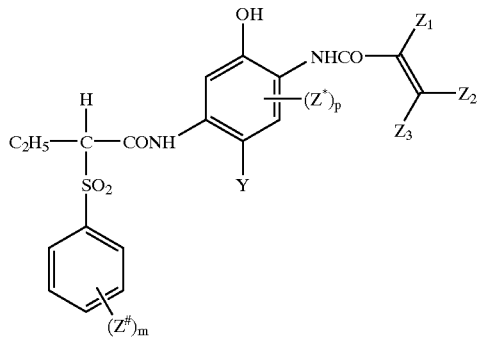

7. The element of claim 3 wherein $W_1$ represents the atoms necessary to form a pyridine ring represented by formulae (VII)–(IX):

(VII)

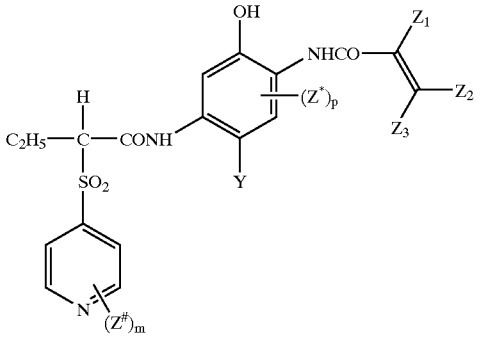

(VIII)

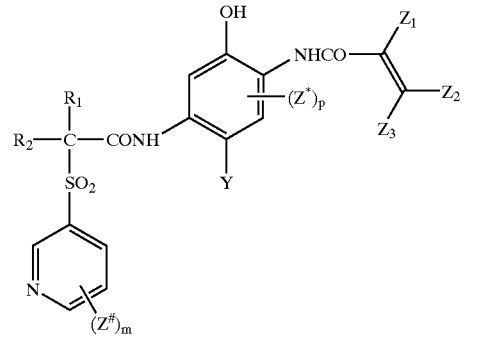

(IX)

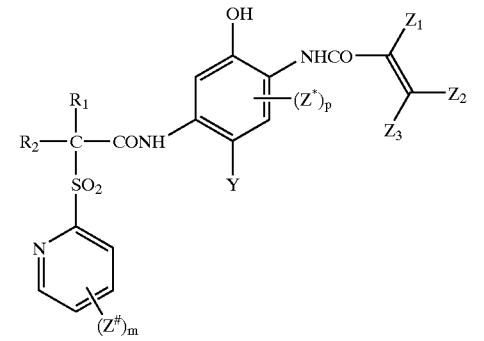

8. The element of claim 1 wherein the coupler is represented by formulae (X)–(XI):

(X)

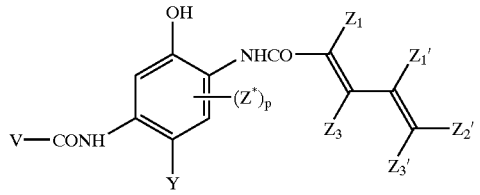

(XI)

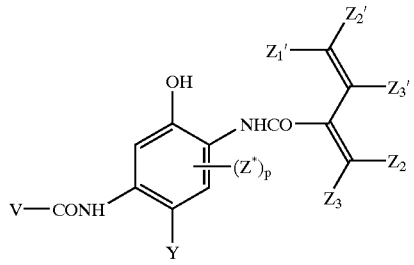

wherein:

$Z_1'$, $Z_2'$, and $Z_3'$ are independently selected groups; and provided that the combined sum of the aliphatic carbon atoms in V, $Z_1$, $Z_2$, $Z_3$, $Z_1'$, Z2', Z3', and all Z*, is at least 8.

9. The element of claim 2 wherein $W_1$ is a heterocycle selected from the group consisting of benzimidazolyl, benzoselenazolyl, benzothiazolyl, benzoxazolyl, chromonyl, furyl, imidazolyl, indazolyl, indolyl, isoquinolyl, isothiazolyl, isoxazolyl, morpholinyl, oxadiazolyl, oxazolyl, picolinyl, piperidinyl, purinyl, pyradazinyl, pyranyl, pyrazinyl, pyrazolyl, pyridyl, pyrimidinyl, pyrrolyl, pyrrolidinyl, quinaldinyl, quinazolinyl, quinolyl, quinoxalinyl, selenazoyl, tellurazolyl, tetrazolyl, tetrahydrofuiryl, thiadiazolyl, thiamorpholinyl, thiatriazolyl, thiazolyl, thienyl, thiophenyl, and triazolyl groups.

10. The element of claim 2 wherein each $Z_1$, $Z_2$, $Z_3$, Z* and $Z^{\#}$ is independently selected from hydrogen, acyl, acyloxy, alkenyl, alkyl, alkoxy, amino, mono and di-substituted amino, aryl, aryloxy, carbamoyl, carbamate, carbonamido, carboxy, carboalkoxy, cyano, halogen, heterocyclic, hydroxy, nitro, oxycarbonyl, oxysulfonyl, sulfamoyl, sulfonamido, sulfonyl, sulfoxide, thio, and ureido groups.

11. The element of claim 3 wherein each $Z_1$, $Z_2$ and $Z_3$ is independently selected from hydrogen, alkyl, aryl, carboalkoxy and cyano groups.

12. The element of claim 3 wherein $Z_2$ and $Z_3$ join to form a carbocyclic ring and $Z_3$ is selected from hydrogen, alkyl, aryl, carboalkoxy and cyano groups.

13. The element of claim 4 wherein each $Z_1$, $Z_2$ and $Z_3$ is independently selected from hydrogen, alkyl, aryl, carboalkoxy and cyano groups.

14. The element of claim 4 wherein $Z_2$ and $Z_3$ join to form a carbocyclic ring and $Z_1$, is selected from hydrogen, alkyl, aryl, carboalkoxy and cyano groups.

15. The element of claim 6 wherein each $Z_1$, $Z_2$ and $Z_3$ is independently selected from hydrogen, alkyl, aryl, carboalkoxy and cyano groups.

16. The element of claim 6 wherein $Z_2$ and $Z_3$ join to form a carbocyclic ring and $Z_1$, is selected from hydrogen, alkyl, aryl, carboalkoxy and cyano groups.

17. The element of claim 8 wherein each $Z_1$, $Z_2$, $Z_3$, $Z_1'$, $Z_2'$ and $Z_3'$ is independently selected from hydrogen, alkyl, aryl, carboalkoxy and cyano groups.

18. A photographic element in accordance with claim 1 wherein the photographic coupler is selected from the following:

IC-1
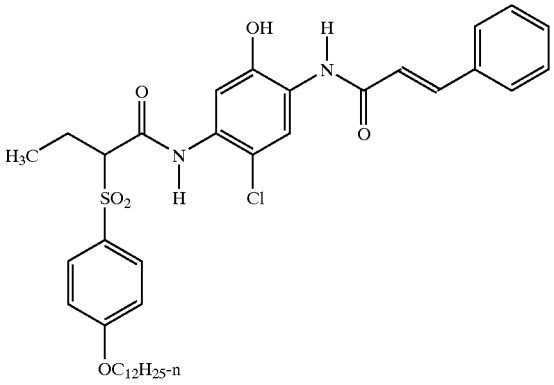
IC-2
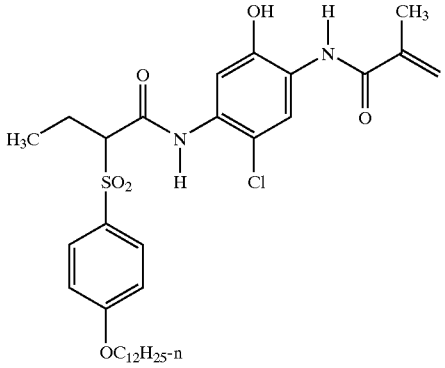
IC-3
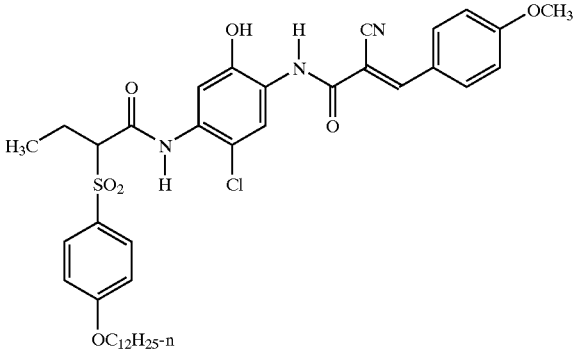
IC-4
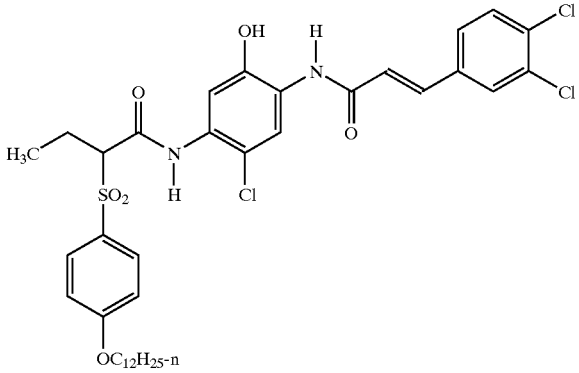
IC-5
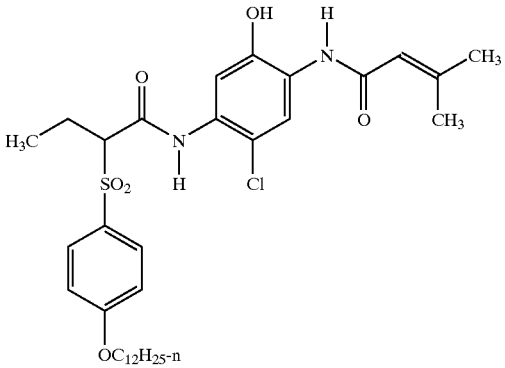
IC-6
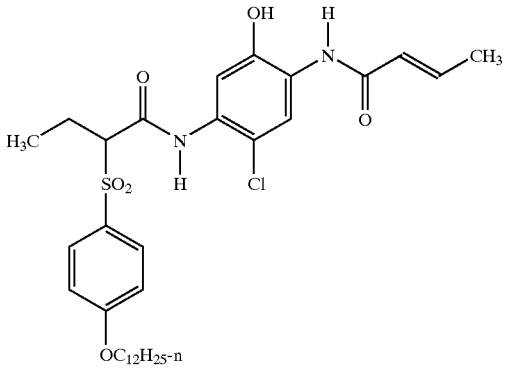
IC-7
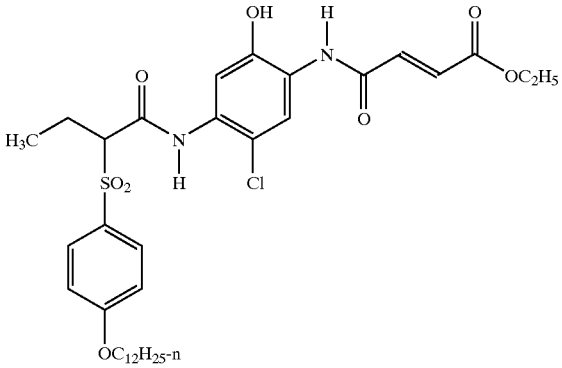
IC-8
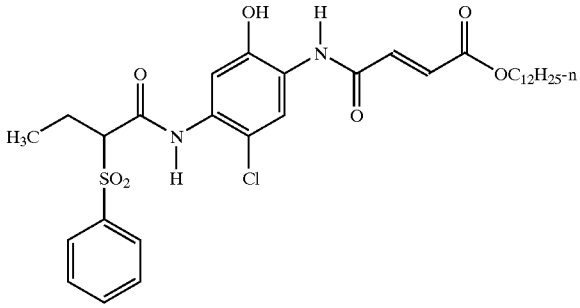

-continued
IC-9
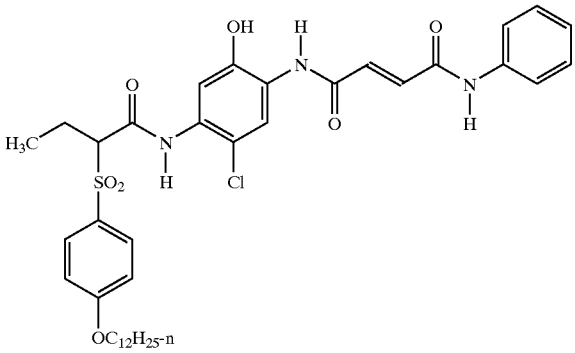
IC-10
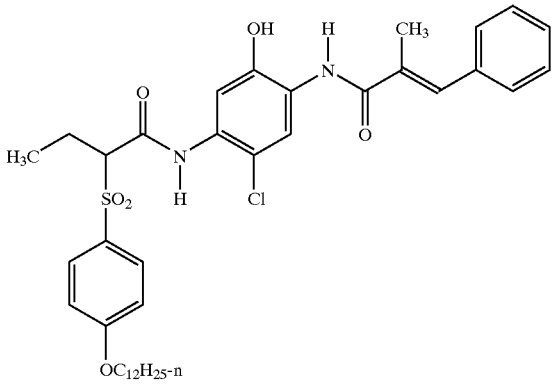
IC-11
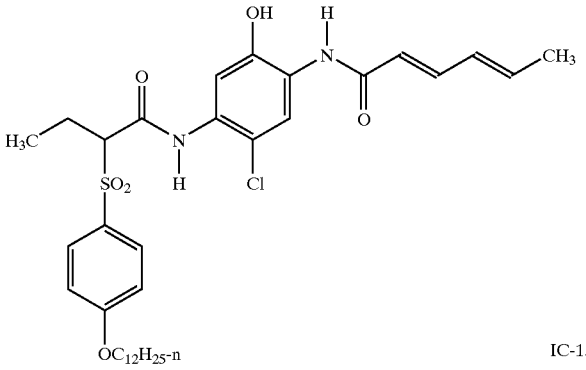
IC-12
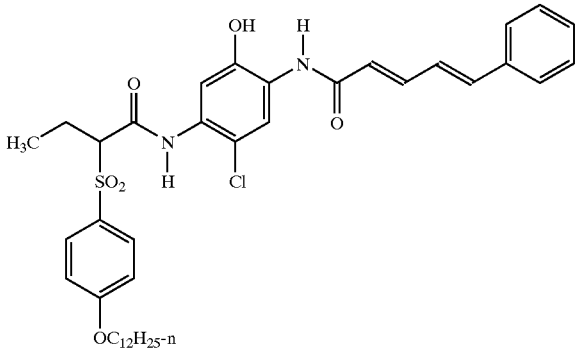
IC-13
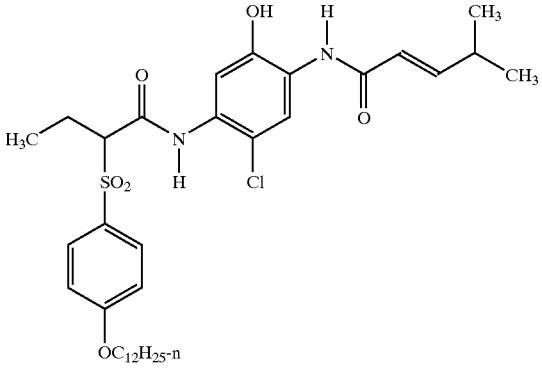
IC-14
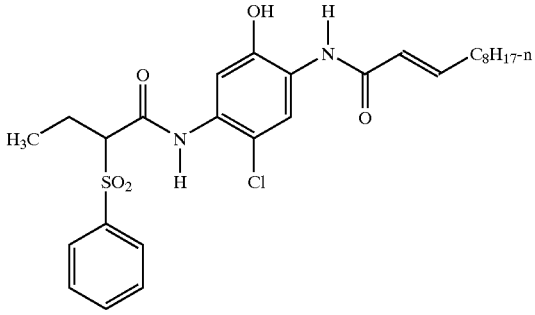
IC-15
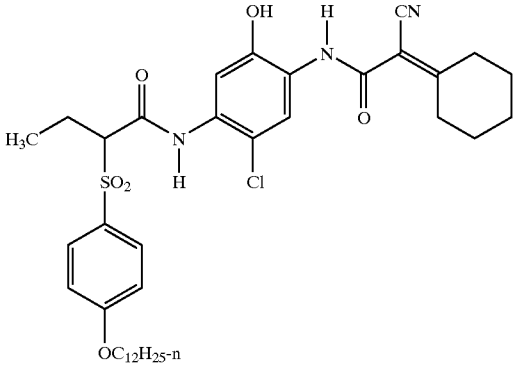
IC-16
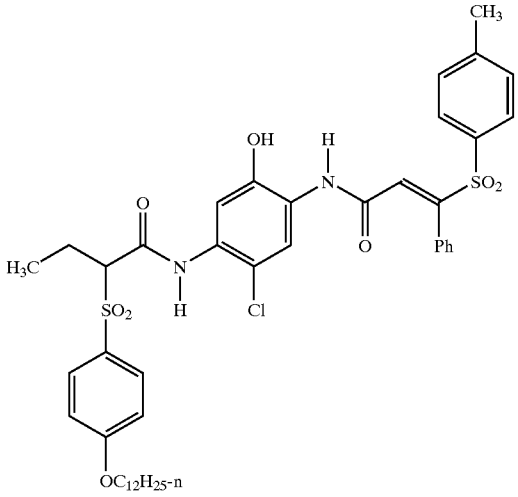

-continued
IC-17
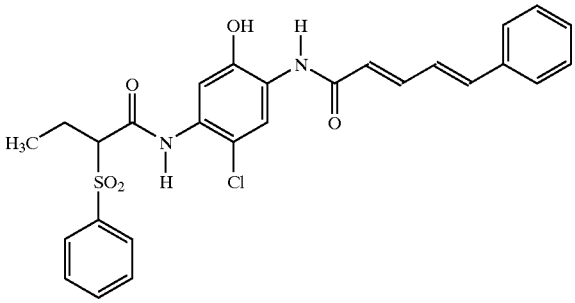
IC-18
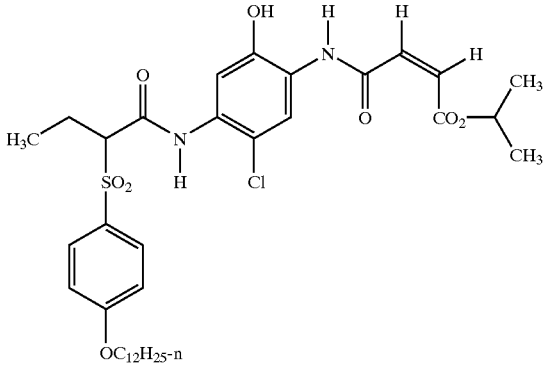
IC-19
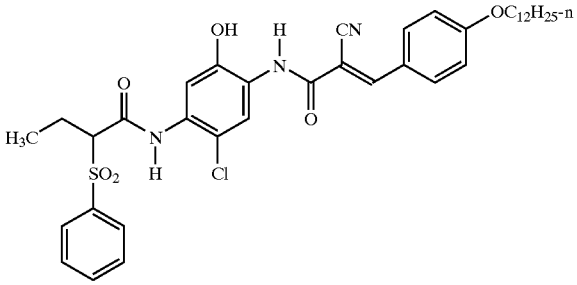
IC-20
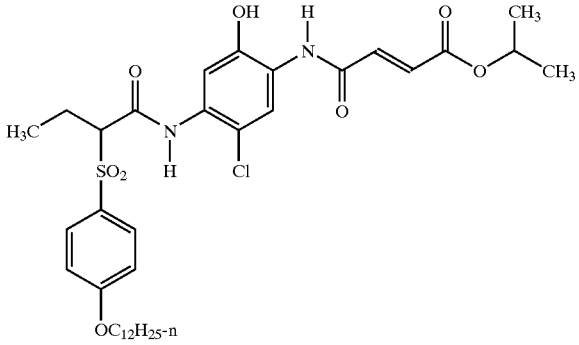
IC-21
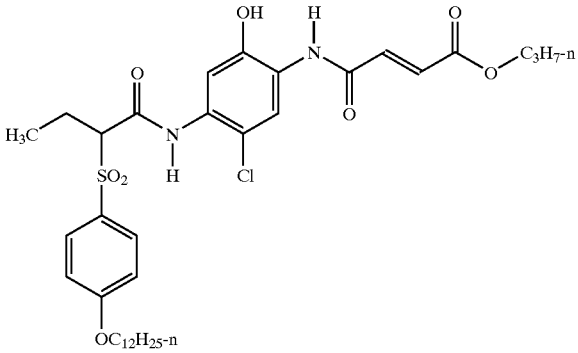
IC-22
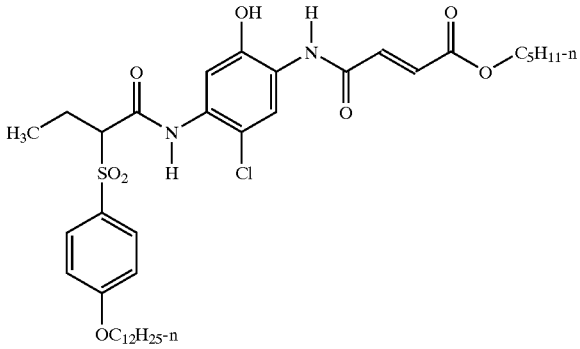
IC-23
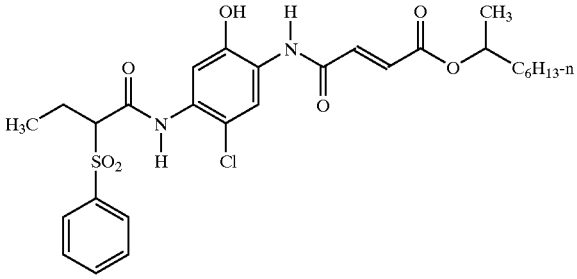
IC-24
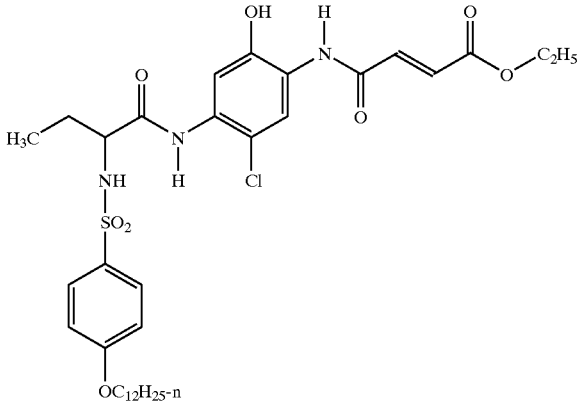

-continued
IC-25
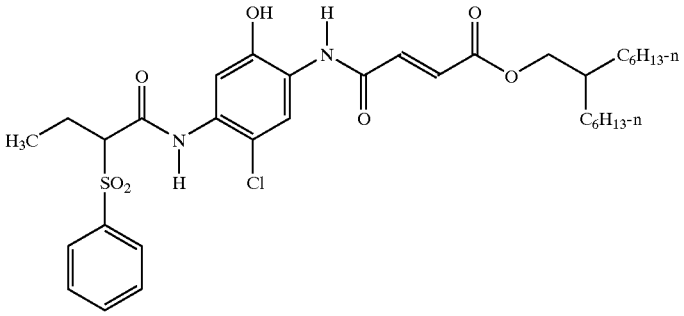
IC-26
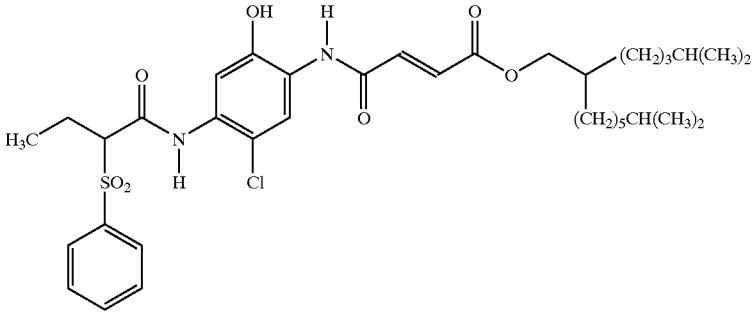
IC-27
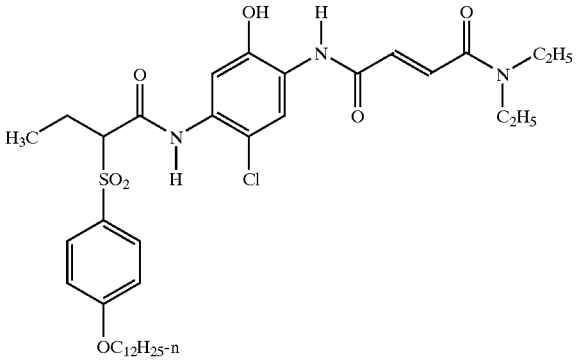
IC-28
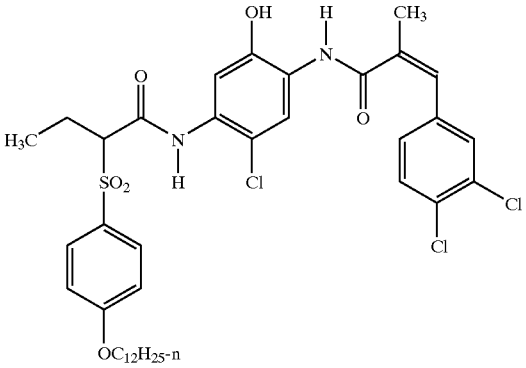
IC-29
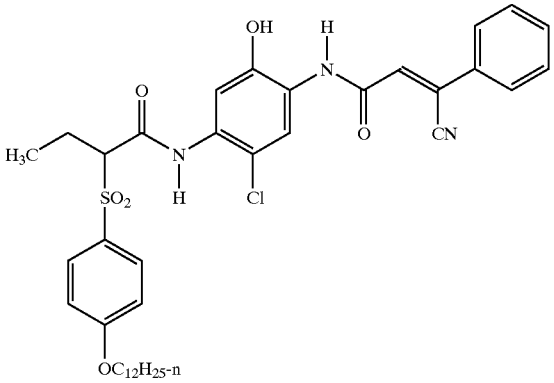
IC-30
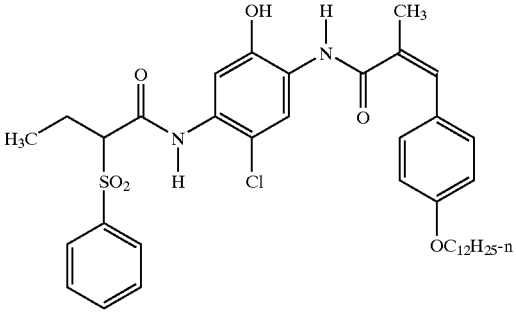

-continued

IC-31

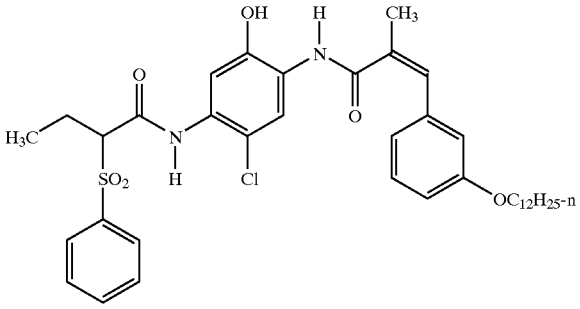

IC-32

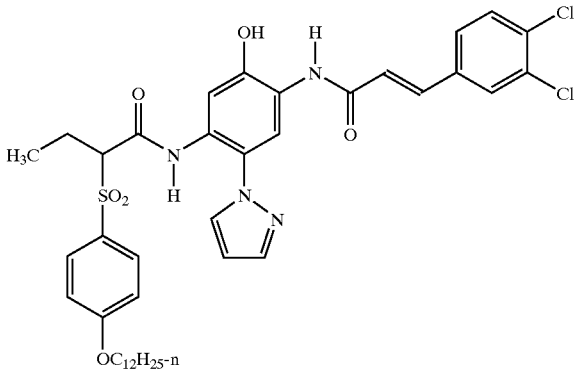

IC-33

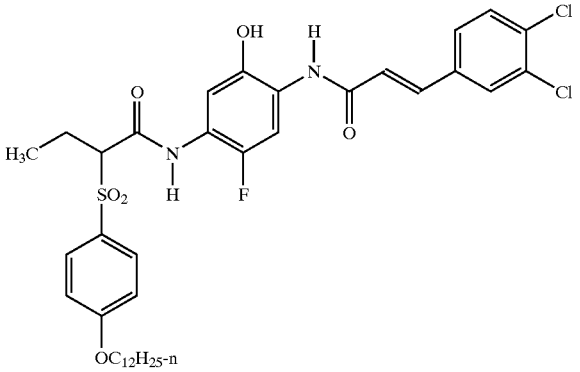

IC-34

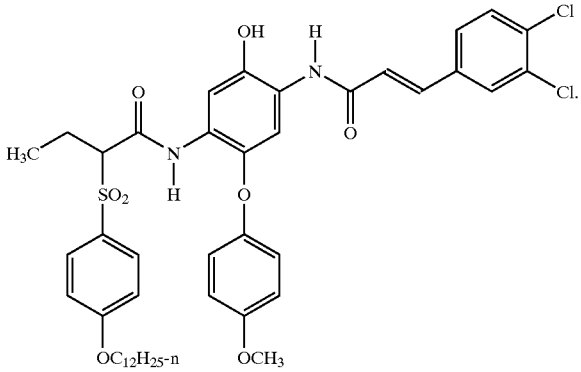

19. The photographic element of claim 1 comprising a support bearing at least one red sensitive photographic silver halide emulsion layer comprising at least one cyan image dye-forming coupler of formula (I);

at least one green sensitive photographic silver halide emulsion layer comprising at least one magenta image dye-forming coupler;

at least one blue sensitive photographic silver halide emulsion layer comprising at least one yellow image dye-forming coupler.

20. The element of claim 1 provided on a reflective support.

21. The element of claim 1 packaged with instruction to process using a color negative print developing process.

22. The element of claim 1 packaged with instructions to process using a color reversal developing process.

23. The element of claim 1 wherein the element is a direct-view element.

24. A photographic element comprising a light-sensitive silver halide emulsion layer having associated therewith a cyan coupler having the formula:

(I)

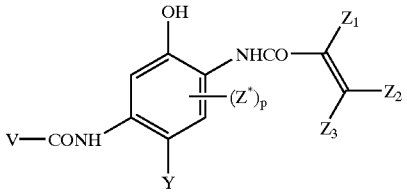

wherein:

V is a sulfone, sulfoxide or sulfonamide-containing group;

Y is H or a coupling-off group;

each $Z_1$, $Z_2$, $Z_3$ and $Z^*$ are an independently selected substituent group where p is 0 to 2;

provided that Zi and $Z_2$ or $Z_2$ and $Z_3$ can join to form a ring;

provided furter that $Z_1$, and $Z_2$ do not join to form an aromatic or heterocyclic ring; and provided further that the combined sum of the aliphatic carbon atoms in V, all $Z_1$, $Z_2$, $Z_3$ and all $Z^*$ is at least 8.

25. The photographic element of claim 1 in which the NB coupler represents a coupler that forms a dye for which the left bandwidth (LBW) using spin-coating is at least 10 nm less than that of the same dye in solution form.

26. The photographic element of claim 1 in which the NB coupler represents a coupler that forms a dye for which the left bandwidth (LBW) using spin-coating is at least 15 nm less than that of the same dye in solution form.

27. The photographic element of claim 1 in which the NB coupler represents a coupler that forms a dye for which the left bandwidth (LBW) using spin-coating is at least 20 mn less than that of the same dye in solution form.

28. A process for forming an image in an element as described in claim 1 after the element has been imagewise exposed to light comprising contacting the element with a color-developing compound.

29. The process of claim 28 in which the developer is a p-phenylene diamine compound.

* * * * *

UNITED STATES PATENT AND TRADEMARK OFFICE

CERTIFICATE OF CORRECTION

PATENT NO. : 6,689,549 B1
DATED : February 10, 2004
INVENTOR(S) : William B. Begley et al.

It is certified that error appears in the above-identified patent and that said Letters Patent is hereby corrected as shown below:

Column 15,
Structure IC-25 should be

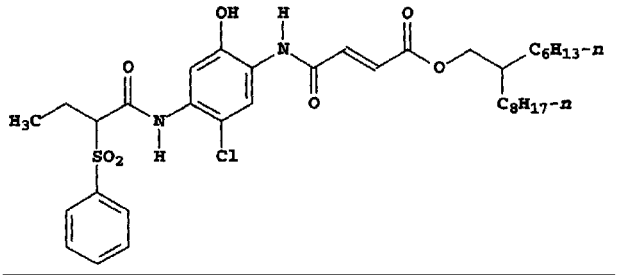

Column 41,
Line 6, after "at least" delete "Snm" and insert -- 5nm --

Column 51,
Structure IC-25 should be

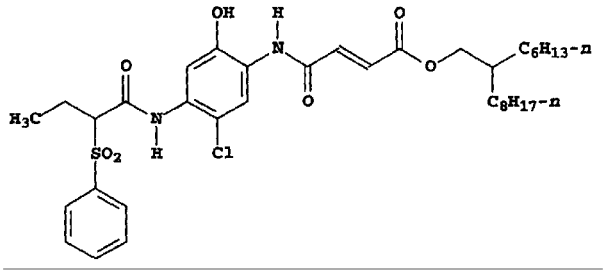

Signed and Sealed this

Fourteenth Day of September, 2004

JON W. DUDAS
*Director of the United States Patent and Trademark Office*